US008888274B2

(12) United States Patent
Inoue

(10) Patent No.: US 8,888,274 B2
(45) **Date of Patent: *Nov. 18, 2014**

(54) PAPER CONVEYANCE APPARATUS AND INK JET RECORDING APPARATUS

(71) Applicant: FUJIFILM Corporation, Tokyo (JP)

(72) Inventor: Takahiro Inoue, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/763,465

(22) Filed: Feb. 8, 2013

(65) Prior Publication Data

US 2013/0215204 A1 Aug. 22, 2013

(30) Foreign Application Priority Data

Feb. 21, 2012 (JP) ..... 2012-035132

(51) Int. Cl.

| | |
|---|---|
| ***B41J 2/01*** | (2006.01) |
| ***B41J 13/10*** | (2006.01) |
| ***B41F 21/10*** | (2006.01) |
| ***B41J 13/22*** | (2006.01) |
| ***B65H 5/36*** | (2006.01) |
| ***B65H 5/12*** | (2006.01) |

(52) U.S. Cl.

CPC ..... *B41J 13/10* (2013.01); *B65H 2301/51242* (2013.01); *B65H 2406/362* (2013.01); *B65H 2406/351* (2013.01); *B41F 21/10* (2013.01); *B41J 13/223* (2013.01); *B65H 5/36* (2013.01); *B65H 5/12* (2013.01)

USPC ..... 347/104; 347/101; 347/103; 347/16

(58) Field of Classification Search

CPC .. B41J 13/226; B41J 11/0085; B41J 11/0005; B41J 15/16

USPC ..... 347/104, 101, 103, 16, 105

See application file for complete search history.

(56) References Cited

U.S. PATENT DOCUMENTS 4,493,255 A 1/1985 Fischer
6,378,425 B1 * 4/2002 Stephan ..... 101/232

(Continued)

FOREIGN PATENT DOCUMENTS

EP 0085751 A1 8/1983
EP 0872342 A2 10/1998

(Continued)

OTHER PUBLICATIONS

The extended European search report issued on Jun. 20, 2013, which corresponds to EP 13151434.1 and is related to U.S. Appl. No. 13/763,465.

(Continued)

*Primary Examiner* — Henok Legesse
(74) *Attorney, Agent, or Firm* — Studebaker & Brackett PC

(57) ABSTRACT

A paper conveyance apparatus includes: a drum that conveys a paper by winding the paper around an outer peripheral surface thereof and being rotated; a press roller that presses a surface of the paper at a predetermined position on the outer peripheral surface of the drum and brings a reverse surface of the paper into contact with the outer peripheral surface of the drum; and a back tension providing unit having an adsorption surface by which the surface or the reverse surface of the paper is absorbed, the back tension providing unit being configured so that provides the paper with a back tension by causing the adsorption surface to adsorb the surface or the reverse surface of the paper with an adsorption force which decreases from the center in a width direction of the paper toward both ends in the width direction of the paper.

18 Claims, 28 Drawing Sheets

(56) References Cited

U.S. PATENT DOCUMENTS

| | | | | |
|---|---|---|---|---|
| 8,337,008 | B2 | 12/2012 | Kachi | |
| 8,342,635 | B2 | 1/2013 | Sasaki et al. | |
| 2002/0167578 | A1* | 11/2002 | Miki et al. | 347/104 |
| 2009/0231377 | A1* | 9/2009 | Kachi | 347/16 |
| 2009/0291215 | A1 | 11/2009 | Makuta et al. | |
| 2011/0316953 | A1 | 12/2011 | Kaneko et al. | |
| 2012/0224012 | A1* | 9/2012 | Inoue et al. | 347/104 |
| 2012/0242736 | A1* | 9/2012 | Imamura | 347/16 |

FOREIGN PATENT DOCUMENTS

| | | | |
|---|---|---|---|
| EP | 1010525 | A1 | 6/2000 |
| EP | 2505369 | A1 | 10/2012 |
| JP | 04-018381 | A | 1/1992 |
| JP | H05-107969 | A | 4/1993 |
| JP | 11-314417 | A | 11/1999 |
| JP | 2001-002283 | A | 1/2001 |
| JP | 3690182 | B2 | 8/2005 |
| JP | 2009-220954 | A | 10/2009 |
| JP | 2009-279870 | A | 12/2009 |
| JP | 2011-025498 | A | 2/2011 |
| JP | 2011-121743 | A | 6/2011 |
| JP | 2011178547 | A | 9/2011 |

OTHER PUBLICATIONS

An Office Action; "Notice of Reasons for Rejection," issued by the Japanese Patent Office on Jan. 7, 2014, which corresponds to Japanese Patent Application No. 2012-035132 and is related to U.S. Appl. No. 13/763,465; with English language translation.

* cited by examiner

PAPER CONVEYANCE APPARATUS AND INK JET RECORDING APPARATUS

BACKGROUND OF THE INVENTION

1. Field of the Invention

The present invention relates to a paper conveyance apparatus and an ink jet recording apparatus, and in particular to a technology which conveys a paper using a drum.

2. Description of the Related Art

As a paper conveyance method of a printer which prints on a sheet of paper, a drum conveyance method is known. In the drum conveyance method, paper is conveyed by winding the paper (sheet of paper) around the peripheral surface of a drum and rotating the drum about the axis.

In the printer adopting the drum conveyance method, in order to print a high-quality image, it is required to convey the paper without causing wrinkles, floats or the like. In particular, in the printer which prints using an ink jet method, if the floats or the wrinkles occur on the paper, there is a problem in that not only does the print quality deteriorate but also a nozzle surface of a head is worn by the float of the paper.

JP2009-220954A discloses a method where in an ink jet recording apparatus adopting the drum conveyance, in order to prevent the occurrence of wrinkles or floats on the paper, when the paper is wound around the drum, the paper is wound while being provided with back tension (tensions in the opposite direction to the paper conveyance direction). According to this method, the paper is wound around the drum while being stretched. Therefore, it is possible to suppress the occurrence of the wrinkles or the floats.

In addition, JP2009-279870A, JP1992-018381A (JP-H04-018381A), JP1999-314417A (JP-H11-314417A) and JP2011-025498A disclose a technology which changes the back tension to be provided depending on a type, thickness or the like of the paper, when the paper is provided with back tension.

SUMMARY OF THE INVENTION

In a paper conveyance apparatus of the related art, in a case where a paper is provided with back tension, the back tension is provided so as to uniformly act throughout the paper in the width direction.

However, in such a method of providing the back tension, wrinkles can be stretched rearward, but cannot be dispersed. Accordingly, there is a problem in that the wrinkles accumulate in the rear in a case of using paper with an extremely large amount cockles.

The present invention is made in consideration of such circumstances and an object thereof is to provide the paper conveyance apparatus and an ink jet recording apparatus capable of conveying without causing the wrinkles or floats to form.

Means for solving problems are as follows.

A first aspect of a paper conveyance apparatus which conveys a sheet of paper includes: a drum that conveys a paper by winding the paper around an outer peripheral surface thereof and being rotated; a press roller that presses a surface of the paper at a predetermined position on the outer peripheral surface of the drum and brings a reverse surface of the paper into contact with the outer peripheral surface of the drum; and a back tension providing unit having an adsorption surface by which the surface or the reverse surface of the paper to be wound around the drum is absorbed, the back tension providing unit being configured so that provides the paper with a back tension by causing the adsorption surface to adsorb the surface or the reverse surface of the paper with an adsorption force which decreases from the center in a width direction of the paper toward both ends in the width direction of the paper.

According to this aspect, the paper conveyance apparatus includes a back tension providing unit that adsorbs the surface or the reverse surface to be wound around the drum and provides the paper to be wound around the drum with back tension. The back tension providing unit, having the adsorption surface, adsorbs the surface or the reverse surface of the paper using the adsorption surface and provides the paper with back tension. At this time, the surface or the reverse surface of the paper is adsorbed such that the adsorption force is decreased from the center in the width direction of the paper toward both ends in the width direction. Accordingly, wrinkles are dispersed in the width direction and thus it is possible to prevent accumulation of the wrinkles in the rear end of the paper.

A second aspect of the paper conveyance apparatus according to the first aspect is that the back tension providing unit may include: a suction chamber; a plurality of adsorption holes that is formed on the adsorption surface and communicates with the suction chamber; and a suction unit that sucks the suction chamber, The adsorption force may be decreased from the center in the width direction of the paper toward both ends in the width direction with the plurality of adsorption holes on the adsorption surface being formed in a manner so that an opening ratio of the adsorption surface resulting from the adsorption holes is decreased from the center in a width direction of the adsorption surface toward both ends in the width direction.

According to this aspect, the paper is adsorbed by the multiple adsorption holes formed on the adsorption surface and is adsorbed on the adsorption surface. The adsorption hole is formed such that the opening ratio (ratio of the opening size) is decreased toward both ends in the width direction from the center in the width direction. Accordingly, the adsorption holes are formed such that the adsorption force is decreased toward both ends in the width direction from the center in the width direction.

A third aspect of the paper conveyance apparatus according to the second aspect is that an opening size of the adsorption holes may be made smaller the closer the adsorption holes are placed to both ends in the width direction of the adsorption surface.

According to this aspect, the adsorption holes are formed on the adsorption surface such that the opening size of the adsorption holes becomes smaller as it is placed closer to both ends in the width direction of the adsorption surface. That is, the adsorption holes with a smaller diameter are formed on the adsorption surface, closer toward both ends in the width direction. Accordingly, the adsorption holes are formed such that the opening ratio of the adsorption surface is decreased from the center in the width direction toward both ends in the width direction.

A fourth aspect of the paper conveyance apparatus according to the third aspect is that the opening size of the adsorption holes may be adjustable by configuring the adsorption holes to be expandable and contractible.

According to this aspect, the adsorption holes are formed so as to be expandable and contractible. Accordingly, the opening size of the adsorption holes can be controlled and it is possible to control the adsorption force depending on the paper.

A fifth aspect of the paper conveyance apparatus according to the second aspect is that placement density of the adsorption holes may decrease the closer the adsorption holes are placed from the center in the width direction toward both ends in the width direction of the adsorption surface.

According to this aspect, the adsorption holes are formed on the adsorption surface such that the placement density of the adsorption holes is decreased as the adsorption holes are placed from the center in the width direction toward both ends in the width direction. That is, intervals between the adjacent adsorption holes are coarsely formed as they go from the center in the width direction toward both ends in the width direction (intervals between the adjacent adsorption holes are densely formed as they go toward the center in the width).

A sixth aspect of the paper conveyance apparatus according to the first aspect is that the back tension providing unit may include: a suction chamber having a width corresponding to a width of the adsorption surface; a plurality of adsorption holes that is equally placed on the adsorption surface and communicates with the suction chamber; a plurality of division walls which divides an interior of the suction chamber into a plurality of chambers along a width direction of the suction chamber; and a suction unit that individually sucks each of the chambers The adsorption force may be adjusted by individually adjusting a suction force with which the suction unit suck each of the chambers.

According to this aspect, in such a manner that the adsorption holes are equally placed on the entire adsorption surface and the adsorption hole sucks the suction chamber to communicate therewith, the paper is adsorbed on the adsorption surface. The interior of the suction chamber is divided into a plurality of the chambers by a plurality of the division walls and each of the chambers is individually sucked by the suction unit. Therefore, it is possible to adjust the adsorption force on each region in the width direction by individually adjusting the suction force of each chamber.

A seventh aspect of the paper conveyance apparatus according to the sixth aspect is that the suction unit may include: individual suction tubes which individually communicate with each of the chambers; individual suction pumps which are individually connected to each of the individual suction tubes; and individual valves which are individually provided at each of the individual suction tubes, and whose opening amount is adjustable, The suction force may be adjusted by individually adjusting the opening amount of each of the individual valves.

According to this aspect, the individual suction tubes communicate with each of the chambers divided by the division walls. Then, the individual suction pumps and the individual valves are individually provided at each of the individual suction tubes. The individual suction pumps are driven using a constant drive force and the opening amount of the individual valve is individually adjusted. Accordingly, the suction force of each chamber is adjusted.

An eighth aspect of the paper conveyance apparatus according to the sixth aspect is that the suction unit may include: individual suction tubes which individually communicate with each of the chambers; a common suction tube to which each of the individual suction tubes is connected; a common suction pump which is connected to the common suction tube; and individual valves which are individually provided at each of the individual suction tubes, and whose opening amount is adjustable The suction force may be adjusted by individually adjusting the opening amount of each of the individual valves.

According to this aspect, the individual suction tubes individually communicate with each of the chambers which are divided by the division walls. Each of the individual suction tubes is connected to the common suction pump which is in common via the common suction tube. The individual valves are individually provided at each of the individual suction tubes and the suction force of each chamber is adjusted by individually adjusting the opening amount of each individual valve.

A ninth aspect of the paper conveyance apparatus according to any one of the sixth to eighth aspects may further include a paper information acquisition unit that acquires paper information; and a control unit that controls the suction unit based on the paper information acquired by the paper information acquisition unit.

According to this aspect, the suction unit is controlled, based on the paper information. Accordingly, the paper can be adsorbed using the adsorption force depending on the paper and it is possible to provide each paper with the appropriate back tension.

A tenth aspect of the paper conveyance apparatus according to the ninth aspect is that the paper information acquisition unit may acquire at least a piece of information related to a type, thickness, air permeability of the paper and whether or not the paper is printed.

According to this aspect, the suction unit is controlled, based on at least one piece of information related to the type, thickness, air permeability of the paper and whether or not the paper is printed (whether or not the reverse surface side is to be printed in a case of duplex printing). Accordingly, the paper can be adsorbed using the adsorption force depending on the paper and it is possible to provide each paper with the appropriate back tension.

An eleventh aspect of the paper conveyance apparatus according to the first aspect is that the back tension providing unit may include: a suction chamber having a width corresponding to a width of the adsorption surface; a plurality of adsorption holes that is equally placed on the adsorption surface and communicates with the suction chamber; a plurality of division walls which divides an interior of the suction chamber into a plurality of chambers along a width direction of the suction chamber; communication ports which are formed on the respective division walls and communicate with the adjacent chambers; and a suction unit that individually sucks each of the chambers An opening size of the communication port may be made smaller the closer the division walls are placed to both ends in the width direction of the adsorption surface.

According to this aspect, the paper is adsorbed on the adsorption surface in such a manner that the adsorption holes are equally placed on the entire adsorption surface and the suction chamber which communicates with the adsorption holes is sucked. The interior of the suction chamber is divided into a plurality of the chambers, and the adjacent chambers communicate with each other via the communication ports formed on each division wall. Therefore, if one chamber (for example, the chamber in the center) is sucked, each of the chambers are sucked. In the communication ports formed on each division wall, the division wall placed closer to both ends in the width direction of the adsorption surface is configured to have the smaller opening size. Accordingly, the adsorption surface is formed such that the adsorption force becomes weaker as it goes closer to both ends in the width direction from the center in the width direction.

A twelfth aspect of the paper conveyance apparatus according the eleventh aspect is that the opening size of the communication ports may be adjustable by configuring the communication ports to be expandable and contractible.

According to this aspect, the communication ports formed on each division wall are formed so as to be expandable and contractible. Therefore, if the opening size of each communication port is adjusted, the suction force of each chamber can be adjusted and the adsorption force of the adsorption surface can be adjusted. Accordingly, it is possible to adjust the adsorption force depending on the paper.

A thirteenth aspect of the paper conveyance apparatus according to any one of the first to twelfth aspects is that the back tension providing unit may provide the paper with the back tension by adsorbing the surface of the paper at a position immediately before where the paper enters between the drum and the press roller.

According to this aspect, the surface of the paper is adsorbed at the position immediately before where the paper enters between the drum and the press roller, and the paper is provided with back tension. Since the paper is adsorbed at the position immediately before where the paper enters between the drum and the press roller, the tension can be provided until immediately before the paper is wound around the drum. Accordingly, it is possible to more reliably prevent the occurrence of wrinkles or floats. In addition, in a case of a printed paper, it is possible to prevent a printed image from being impaired, by sucking the surface side.

An aspect of the ink jet recording apparatus includes: the paper conveyance apparatus according to any one of claims 1 to 13; and an ink jet head that ejects ink droplets onto the paper conveyed by the drum to record images on the surface of the paper.

According to this aspect, the ink droplets are ejected onto the paper conveyed by the drum and the image is recorded on the surface of the paper. Since the paper is conveyed without the wrinkles or the floats, it is possible to print a high-quality image. In addition, since the paper does not come into contact with the heads, it is possible to stably perform a recording process for the image.

According to the present invention, it is possible to convey the paper without causing wrinkles or floats. Therefore, it is possible to record a high-quality image.

BRIEF DESCRIPTION OF THE DRAWINGS

FIG. 20 is a configuration diagram of a system for controlling an adsorption force acting on a paper depending on a type of the paper and the like.

DESCRIPTION OF THE PREFERRED EMBODIMENTS

Hereinafter, preferred embodiments of the present invention will be described in detail with reference to the accompanying drawings.

Overall Configuration of Ink Jet Recording Apparatus

Figure 1:
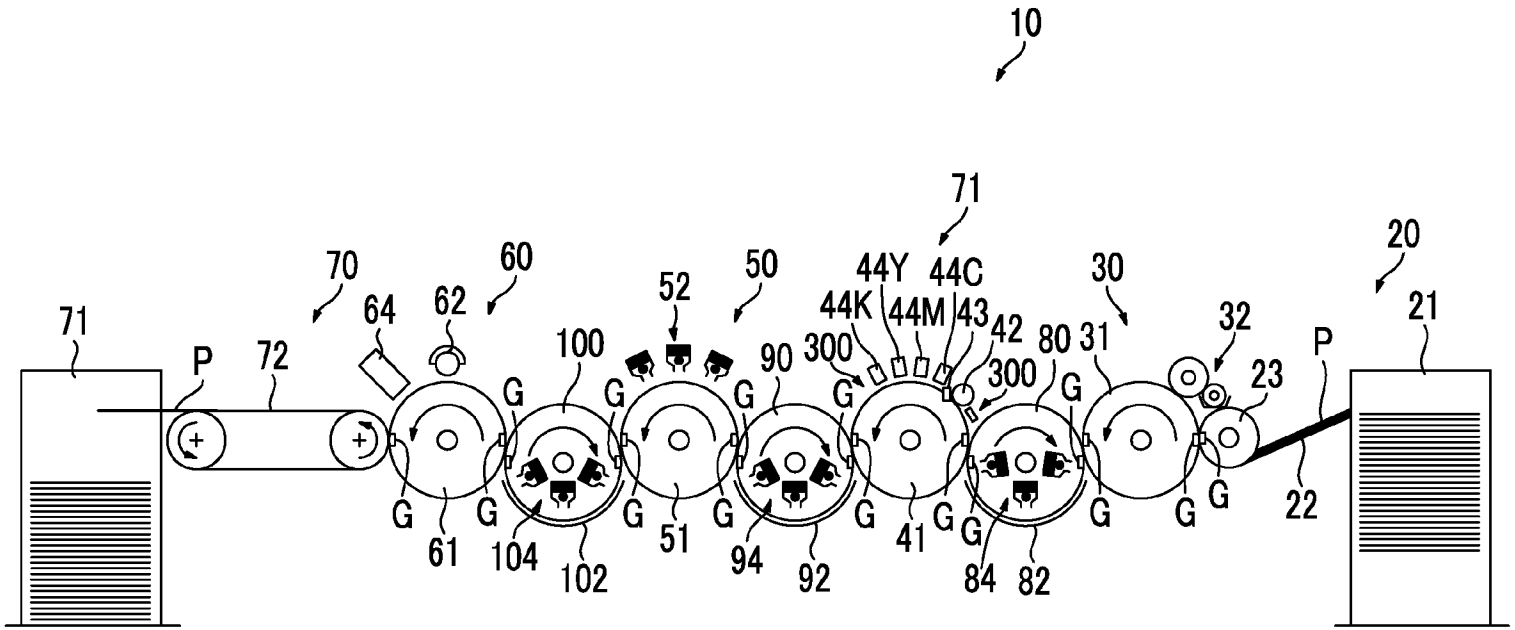
FIG. 1 is an overall configuration diagram illustrating an embodiment of an ink jet recording apparatus.

FIG. 1 is an overall configuration diagram illustrating an embodiment of an ink jet recording apparatus according to the present invention.

The ink jet recording apparatus 10 is an apparatus which prints on a sheet of paper P using an ink jet printing method, using water-based ink (ink in which coloring materials such as a colorant and a pigment are dissolved or dispersed in water and a water soluble solvent). The ink jet recording apparatus 10 includes a paper feeding unit 20 which feeds a paper P, a process liquid applying unit 30 which applies a predetermined process liquid onto the surface (printing surface) of the paper P, an image recording unit 40 which draws a color image on the printing surface of the paper P by landing ink droplets of each color such as cyan (C), magenta (M), yellow (Y) and black (K), using ink jet heads, an ink drying unit 50 which dries the ink droplets landed on the paper P, a fixing unit 60 which fixes the image recorded on the paper P, and a collection unit 70 which collects the paper P.

Each unit of the process liquid applying unit 30, the image recording unit 40, the ink drying unit 50 and the fixing unit 60 respectively includes conveyance drums 31, 41, 51 and 61 as a conveyance means for the paper P. The paper P is conveyed to each unit of the process liquid applying unit 30, the image recording unit 40, the ink drying unit 50 and the fixing unit 60 by the conveyance drums 31, 41, 51 and 61.

Each of the conveyance drums 31, 41, 51 and 61 is formed in a cylindrical shape and is formed corresponding to the paper width of the paper P to be printed. Accordingly, in a case of printing on paper with a different size, the conveyance drums are formed corresponding to the maximum width of paper P.

Each of the conveyance drums 31, 41, 51 and 61 is driven and rotated by a motor which is not illustrated (in FIG. 1, rotated counterclockwise). The paper P is conveyed by being wound around the outer peripheral surface of each of the conveyance drums 31, 41, 51 and 61.

A gripper is provided on the peripheral surface of each of the conveyance drums 31, 41, 51 and 61. The paper P is conveyed by the leading edge being gripped by the gripper. In this example, grippers G are disposed at two places on the peripheral surface of each of the conveyance drums 31, 41, 51 and 61. The grippers G are disposed at an interval of 180 degrees. Accordingly, it is possible to convey two sheets of paper in a single rotation.

In addition, each of the conveyance drums 31, 41, 51 and 61 includes an adsorption holding mechanism which adsorbs and holds the paper P wound on the outer peripheral surface. In this example, the paper P is adsorbed and held on the outer peripheral surface using air pressure (negative pressure). Therefore, multiple adsorption holes are formed on each of the conveyance drums 31, 41, 51 and 61. The paper P, the reverse surface thereof being sucked from the adsorption hole, is adsorbed and held on the outer peripheral surface of each of the conveyance drums 31, 41, 51 and 61. The adsorption holding mechanism can also adopt an electrostatic method (so-called electrostatic adsorption method).

Delivery cylinders (rotation conveyance means) 80, 90 and 100 are respectively placed between the process liquid applying unit 30 and the image recording unit 40, between the image recording unit 40 and the ink drying unit 50, and between the ink drying unit 50 and the fixing unit 60. The paper P is conveyed across each of the units by the delivery cylinders 80, 90 and 100.

Each of the delivery cylinders 80, 90 and 100 is configured by a cylindrical frame body and is formed corresponding to the paper width. Each of the delivery cylinders 80, 90 and 100 is driven and rotated by a motor which is not illustrated (in FIG. 1, rotated clockwise).

The grippers G are provided on the peripheral surface of each of the delivery cylinders 80, 90 and 100. The paper G is conveyed by the leading edge being gripped by the grippers G. In this example, the grippers G are disposed at two places on the outer peripheral surface of each of the delivery cylinders 80, 90 and 100. The grippers G are disposed at an interval of 180 degrees. Accordingly, it is possible to convey two sheets of paper in a single rotation.

Arc-shaped guide plates 82, 92 and 102 are arranged along the conveyance route of the paper P, at the bottom of each of the delivery cylinders 80, 90 and 100. The paper P conveyed by the delivery cylinders 80, 90 and 100 is conveyed while the reverse surface (opposite side surface to the printing surface) is guided by the guide plates 82, 92 and 102.

In addition, dryers 84, 94 and 104 blowing hot air toward the paper P conveyed by the delivery cylinder 80 are disposed inside each of the delivery cylinders 80, 90 and 100 (in this example, three dryers are disposed along the conveyance route of the paper P). The paper P conveyed by each of the delivery cylinders 80, 90 and 100 has the printing surface thereof exposed to the hot air blown from the driers 84, 94 and 104 during a conveyance course. Accordingly, it is possible to perform a drying process for the paper P during the conveyance course by each of the delivery cylinders 80, 90 and 100.

Furthermore, it is also possible to adopt a configuration where the driers 84, 94 and 104 radiate heat from an infrared heater or the like (so-called heat using radiation) instead of the configuration of heating by blowing hot air.

The paper P fed from the paper feeding unit 20 is conveyed from the conveyance drum 31, through the delivery cylinder 80, the conveyance drum 41, the delivery cylinder 90, the conveyance drum 51, and the delivery cylinder 100 to the conveyance drum 61 in this order, and is finally collected by the collection unit 70. During the time from the paper feeding unit 20 until being collected by the collection unit 70, the paper P is subjected to the required processes, and the image is recorded on the printing surface.

Hereinafter, a configuration of each unit of the ink jet recording apparatus 10 according to the present embodiment will be described in detail.

Paper Feeding Unit

The paper feeding unit 20 periodically feeds a sheet of paper P one by one. The paper feeding unit 20 is mainly configured by a paper feeder 21, paper feeding tray 22 and a delivery cylinder 23.

The paper feeder 21 feeds the paper P stacked in a magazine (not illustrated) to the paper feeding tray 22 one by one in order from the upper side.

The paper feeding tray 22 sends out the paper P fed from the paper feeder 21 toward the delivery cylinder 23.

The delivery cylinder 23 receives the paper P sent out from the paper feeding tray 22, and being rotated, passes it to a conveyance drum 31 of a process liquid applying unit 30.

For the paper P, without being particularly limited, all-purpose printing paper used in general offset printing or the like (paper mainly composed of cellulose, such as the so-called fine quality paper, coated paper, art paper) can be used. In this example, a coated paper is used. The coated paper is the paper to which a coating material is applied and the coated layer is provided on the surface of the fine quality paper or a neutral paper which is not generally surface-treated. More specifically, art paper, coated paper, light weight coated paper, fine coating paper and the like are preferably used.

The all-purpose printing paper, if printed using an ink jet method, is to be a poor quality image due to the occurrence of smears. Therefore, in order to prevent such a problem, the ink jet recording apparatus 10 of the present embodiment applies a predetermined process liquid to the printing surface of the paper P in the following process liquid applying unit 30.

Process Liquid Applying Unit

The process liquid applying unit 30 applies a predetermined process liquid to the printing surface of the paper P. The process liquid applying unit 30 is mainly configured by a conveyance drum 31 which conveys the paper P (hereinafter referred to as "process liquid applying drum") and an applying device 32 which applies a predetermined process liquid to the printing surface of the paper P conveyed by the process liquid applying drum 31.

The process liquid applying drum 31 receives the paper P from the delivery cylinder 23 of the paper feeding unit 20 (receives the paper P by gripping the leading edge using the gripper G), being rotated, and conveys the paper P along a predetermined conveyance route.

The applying device 32, using a roller, applies a predetermined process liquid to the printing surface of the paper P conveyed by the process liquid applying drum 31. That is, an applying roller which is provided with the process liquid on the peripheral surface is pressed to and brought into contact with the printing surface of the paper P conveyed by the process liquid applying drum 31 and the process liquid is applied to the printing surface of the paper P. The process liquid is applied with a constant thickness.

The process liquid applied by the applying device 32 is composed of a liquid containing flocculant which aggregates components in ink composition.

As the flocculant, compound which can change the pH of the ink composition, polyvalent metal salt or polyallylamine may be used.

As the compound capable of lowering pH, an example preferably includes highly water soluble acidic substance (phosphoric acid, oxalic acid, malonic acid, citric acid or derivatives of these compounds, salts thereof or the like). The acidic substance may be used alone or may be used in combination with two or more. This increases cohesion and thus it is possible to immobilize the entire ink.

In addition, pH (25° C.) of the ink composition is not less than 8.0 and pH (25° C.) of the process liquid is preferably in the range of 0.5 to 4. Accordingly, it is possible to obtain faster image density, resolution and ink jet recording.

In addition, the process liquid can contain additives. For example, well-known additives such as an anti-drying agent (wetting agent), discoloration inhibitor, emulsion stabilizer, permeation accelerator, ultraviolet absorber, antiseptic, fungicide, pH adjusting agent, surface tension adjusting agent, defoaming agent, viscosity modifier, dispersant, dispersion stabilizer, rust inhibitor, chelating agent and the like can be additives.

If printed with such a process liquid being applied to the printing surface of the paper P in advance, it is possible to prevent the occurrence of feathering, bleeding and the like. Therefore, even if a general printing paper is used, high-quality printing can be performed.

In the process liquid applying unit 30 with the above configuration, the paper P is held by the process liquid applying drum 31 and conveyed through a predetermined conveyance route. Then, the process liquid is applied to the printing surface by the applying device 32 during the conveyance course.

Thereafter, the paper P where the process liquid is applied to the printing surface is passed to a delivery cylinder 80 from the process liquid applying drum 31 at a predetermined position. Then, the paper P is conveyed through a predetermined conveyance route by the delivery cylinder 80 and passed to a conveyance drum 41 of the image recording unit 40.

Here, as described above, a dryer 84 is disposed inside the delivery cylinder 80 and blows hot air toward a guide plate 82. The paper P has the printing surface exposed to the hot air during the course of being conveyed from the process liquid applying unit 30 to the image recording unit 40 by the delivery cylinder 80, and the process liquid applied to the printing surface is dried (solvent component in the process liquid is evaporated and removed).

Image Recording Unit

The image recording unit 40 draws a color image on the printing surface of the paper P by landing ink droplets of each color, C, M, Y and K. The image recording unit 40 mainly includes a conveyance drum 41 which conveys the paper P (hereinafter referred to as an "image recording drum"), a press roller 42 which presses the printing surface of the paper P and brings the reverse surface of the paper P into contact with the peripheral surface of the image recording drum 41, a paper float detection sensor 43 which detects floats of the paper P, ink jet heads 44C, 44M, 44Y and 44K which eject the ink droplets of each color, C, M, Y and K, and the back tension provider (back tension providing unit) 300 which provides the paper P wound around the image recording drum 41 with back tension.

The image recording drum 41, receiving the paper P from the delivery cylinder 80 by gripping the leading edge of the paper P using the gripper being rotated, and conveys the paper P along a predetermined conveyance route.

The press roller 42 is configured by a rubber roller which has approximately the same width as the width of the image recording drum 41 (roller where at least the outer peripheral surface is configured by rubber (elastic body)), and is placed in the vicinity of a paper receiving position of the image recording drum 41 (position where the paper P is received from the delivery cylinder 80). The paper P passed from the delivery cylinder 80 to the image recording drum 41, the surface thereof being pressed by the press roller 42, is wound while the reverse surface is brought into contact with the outer peripheral surface of the image recording drum 41.

The paper float detection sensor 43 detects the float of the paper P which passes through the press roller 42. That is, the paper float detection sensor 43 detects the float above a certain level from the outer peripheral surface of the image recording drum 41. The paper float detection sensor 43 is configured by a laser projector 43A which projects a laser beam and a laser receiver 43B which receives the laser beam.

The laser projector 43A projects the laser beam parallel to the axis of the image recording drum 41 from one end toward the other end of the image recording drum 41, from the outer peripheral surface of the image recording drum 41 to a predetermined height position (upper limit height position of the allowable range of the float).

The laser receiver 43B is placed opposing the laser projector 43A across the travelling route of the paper P by the image recording drum 41, and receives the laser beam projected by the laser projector 43A.

If a float equal to or more than the allowable value occurs in the paper P conveyed by the image recording drum 41, the laser beam projected from the laser projector 43A is blocked by the paper P. As a result, a receiving amount of the laser beam received by the laser receiver 43B decreases. The paper float detection sensor 43 detects the float of the paper P by detecting the receiving amount of the laser beam received by the laser receiver 43B. That is, the paper float detection sensor 43 determines that the float (float equal to or more than the allowable value) occurs, in a case where the receiving amount is equal to or less than the threshold value, by comparing the receiving amount of the laser beam received by the laser receiver 43B and the threshold value.

If the float equal to or more than the allowable value is detected, the rotation of the image recording drum 41 is stopped and the conveyance of the paper P is stopped.

Further, the paper float detection sensor 43 is configured to be able to adjust the height (height from the outer peripheral surface of the image recording drum 41) of the laser beam projected from the laser projector 43A. Accordingly, it is possible to arbitrarily set the allowable range of the float.

Four ink jet heads 44C, 44M, 44Y and 44K are placed in the rear of the paper float detection sensor 43, that is, downstream in the conveyance direction of the paper P, at regular intervals along the conveyance direction of the paper P. The ink jet heads 44C, 44M, 44Y and 44K are configured by line heads corresponding to the width of the paper, and nozzle surfaces are formed on the lower surface thereof (opposing surface to the outer peripheral surface of the image recording drum 41). Nozzles are placed at a constant pitch in the direction orthogonal to the conveyance direction of the paper P (nozzle lines). Each of the ink jet heads 44C, 44M, 44Y and 44K ejects the ink droplets from the nozzles toward the image recording drum 41.

The ink used in the ink jet recording apparatus 10 of the present embodiment is an aqueous ultraviolet-curable ink, and contains a water-soluble polymerized compound which is polymerized by pigments, polymer particles and active energy rays. The aqueous ultraviolet-curable ink is curable by irradiating ultraviolet rays and has a property of excellent abrasion resistance and high membrane strength.

The pigment, a water-dispersible pigment where at least a portion of the surface thereof is coated by a polymer dispersant, is used.

The polymer dispersant, a polymer dispersant whose acid value is 25 to 1,000 (KOHmg/g), is used. The stability in self-dispersibility and cohesiveness, when the process liquid comes into contact therewith, is good.

The polymer particles, self-dispersing polymer particles whose acid value is 20 to 50 (KOHmg/g), are used. The stability in self-dispersibility and cohesiveness, when the process liquid comes into contact therewith, is good.

A polymerized compound, nonionic or cationic polymerized compound is preferably used in that it does not interfere with the reaction to the flocculants, the pigments and the polymer particles. It is preferable to use the polymerized compound whose solubility with respect to water is 10 percent by mass or more (further 15 percent by mass or more).

In addition, the ink contains an initiator which initiates the polymerization of the polymerized compound using the active energy rays. The initiator can contain appropriately selected compound capable of initiating polymerization reaction using the active energy rays, for example, it is possible to use the initiator (for example, photopolymerization initiator and the like) which generates active species (radicals, acid, base and the like) using radial rays, light rays or electron rays. Furthermore, the initiator can be contained in the process liquid and may be contained in at least one of the ink and the process liquid.

In addition, the ink contains 50 to 70 percent by mass of water. Further, the ink can contain additives. For example, well-known additives such as a water-soluble organic solvent, anti-drying agent (wetting agent), discoloration inhibitor, emulsion stabilizer, permeation accelerator, ultraviolet absorber, antiseptic, fungicide, pH adjusting agent, surface tension adjusting agent, defoaming agent, viscosity modifier, dispersant, dispersion stabilizer, rust inhibitor, chelating agent and the like can be additives.

The back tension provider 300 provides the paper P wound around the image recording drum 41 with back tension by adsorbing the surface of the paper P at the position immediately before where the paper P is pressed by the press roller 42 (position immediately before where the paper P enters between the image recording drum 41 and the press roller 42). The back tension provider 300 includes a paper guide 310 for adsorbing the surface of the paper P across the width direction. The paper guide 310 includes an adsorption surface on which the surface of the paper P is adsorbed and adsorbs the paper P by sucking it from multiple adsorption holes formed on the adsorption surface. The paper P is conveyed while the surface is rubbed against the adsorption surface by the surface being adsorbed on the adsorption surface. Accordingly, the paper P is provided with back tension. Then, since the paper P is provided with the back tension in this manner, when the paper P starts to be wound around the image recording drum 41, the paper P, being stretched, is wound around the image recording drum 41. Accordingly, without causing wrinkles or floats, the paper P can be wound around the peripheral surface of the image recording drum 41. In addition, since the paper P is wound around the image recording drum 41 while being tightly stretched, without causing the wrinkles or the floats, the paper P can be wound around the peripheral surface of the image recording drum 41.

Further, the back tension provider 300 of the present embodiment does not adsorb the paper P using a uniform adsorption force in the width direction of the paper P, when adsorbing the paper P using the adsorption surface, but adsorbs the paper P such that the adsorption force is decreased from the center in the width direction toward both ends in the width direction. Accordingly, deformation occurring in the paper P is not simply stretched rearward, but can be stretched while the deformation is dispersed in the width direction. Therefore, it is possible to more efficiently prevent the occurrence of wrinkles or floats. This point will be described in further detail later, together with a specific configuration of the back tension provider 300.

In the image recording unit 40 with the above configuration, the paper P is conveyed by the image recording drum 41 through a predetermined conveyance route. The paper P passed from the delivery cylinder 80 to the image recording drum 41 is nipped by the press roller 42 while being provided with back tension by the back tension provider 300, and is brought into contact with the outer peripheral surface of the image recording drum 41. Next, the presence of the float is detected by the paper float detection sensor 43 and then the ink droplets of each color, C, M, Y and K from each of the ink jet heads 44C, 44M, 44Y and 44K are landed on the printing surface and the color image is drawn on the printing surface.

Furthermore, in a case where a float of the paper P is detected, the conveyance is stopped. Accordingly, it is possible to prevent the paper P with the float from coming into contact with the nozzle surfaces of the ink jet heads 44C, 44M, 44Y and 44K.

As described above, in the ink jet recording apparatus 10 of this example, water-based ink is used together with each color of the inks. Even in a case of using such a water-based ink, the process liquid is applied to the paper P as described above. Therefore, even in a case of using a general printing paper, it is possible to perform a high-quality printing.

The paper P on which the image is drawn is passed to the delivery cylinder 90. Then, the paper P is conveyed by the delivery cylinder 90 through a predetermined conveyance route and passed to the conveyance drum 51 of the ink drying unit 50.

Here, as described above, the dryer 94 is disposed inside the delivery cylinder 90 and hot air is blown toward the guide plate 92. Although the ink drying process is performed by the ink drying unit 50 in the rear, the paper P is subjected to the drying process even during the conveyance by the delivery cylinder 90.

Further, although not illustrated in the drawing, this image recording unit 40 includes a maintenance unit which performs the maintenance for the ink jet heads 44C, 44M, 44Y and 44K. The ink jet heads 44C, 44M, 44Y and 44K are configured to be moved to the maintenance unit when necessary to enable the required maintenance.

Ink Drying Unit

The ink drying unit 50 dries the liquid component remaining on the paper P of after the image recording. The ink drying unit 50 is mainly configured by a conveyance drum 51 which conveys the paper P (hereinafter referred to as an "ink drying drum") and ink dryer 52 which performs the drying process with respect to the paper P conveyed by the ink drying drum 51.

The ink drying drum 51 receives the paper P from the delivery cylinder 90 (receives the paper P by gripping the leading edge using the grippers G), being rotated, and conveys the paper P along a predetermined conveyance route.

For example, the ink drying unit 52 is configured by dryers (in this example, configured by three dryers arranged along the conveyance route of the paper P), and blows the hot air (for example, 80° C.) toward the paper P conveyed by the ink drying drum 51.

In the ink drying unit 50 with the above-described configuration, the paper P is conveyed by the ink drying drum 51 through a predetermined conveyance route. Then, during the conveyance course, the hot air is blown to the printing surface from the ink dryer 52 and the ink applied to the printing surface is dried (the solvent component is evaporated and removed).

The paper P passing through the ink dryer 52 is then passed to the delivery cylinder 100 at a predetermined position from the ink drying drum 51. Then, the paper P is conveyed by the delivery cylinder 100 through a predetermined route and passed to the conveyance drum 61 of the fixing unit 60.

Further, as described above, the dryer 104 is disposed inside the delivery cylinder 100 and hot air is blown toward the guide plate 102. Accordingly, the paper P is subjected to the drying process even during the conveyance by the delivery cylinder 100.

Fixing Unit

The fixing unit 60, heating and pressing the paper P, fixes the recorded image on the printing surface. The fixing unit 60 is mainly configured by a conveyance drum 61 which conveys the paper P (hereinafter referred to as a "fixing drum"), an ultraviolet ray irradiating light source 62 which irradiates ultraviolet rays to the printing surface of the paper P, and an inline sensor 64 which detects a temperature, humidity and the like of the paper P after printing, and captures the printed image.

The fixing drum 61 receives the paper P from the delivery cylinder 100 (receives the paper P by gripping the leading edge using the grippers G), being rotated, and conveys the paper P along a predetermined conveyance route.

The ultraviolet ray irradiating light source 62 irradiates the ultraviolet rays to the paper P conveyed by the fixing drum 61 and solidifies an aggregate of the process liquid and the ink.

The inline sensor 64 includes a thermometer, hygrometer, CCD line sensor and the like, detects the temperature, humidity and the like of the paper P conveyed by the fixing drum 61, and reads out the image printed on the paper P. Based on the detection result of the inline sensor 64, abnormality of the apparatus, ejection failure of the heads or the like is checked.

In the fixing unit 60 with the above-described configuration, the paper P is conveyed by the fixing drum 61 through the conveyance route. Then, the ultraviolet rays are irradiated to the printing surface from the ultraviolet ray irradiating light source 62 during the conveyance course, and the aggregate of the process liquid and the ink is solidified.

The paper P subjected to the fixing process is passed from the fixing drum 61 to the collection unit 70 at a predetermined position.

Collection Unit

The collection unit 70 collects the paper P on which a series of printing processes is performed, by stacking it on a stacker 71. The collection unit 70 is mainly configured by the stacker 71 which collects the paper P, and a paper output conveyer 72 which receives the paper P subjected to the fixing process in the fixing unit 60 from the fixing drum 61, conveys it through the conveyance route, and outputs the paper to the stacker 71.

The paper P subjected to the fixing process in the fixing unit 60 is passed from the fixing drum 61 to the paper output conveyer 72, conveyed to the stacker 71 by the paper output conveyer 72 and collected into the stacker 71.

Control System

Figure 2:
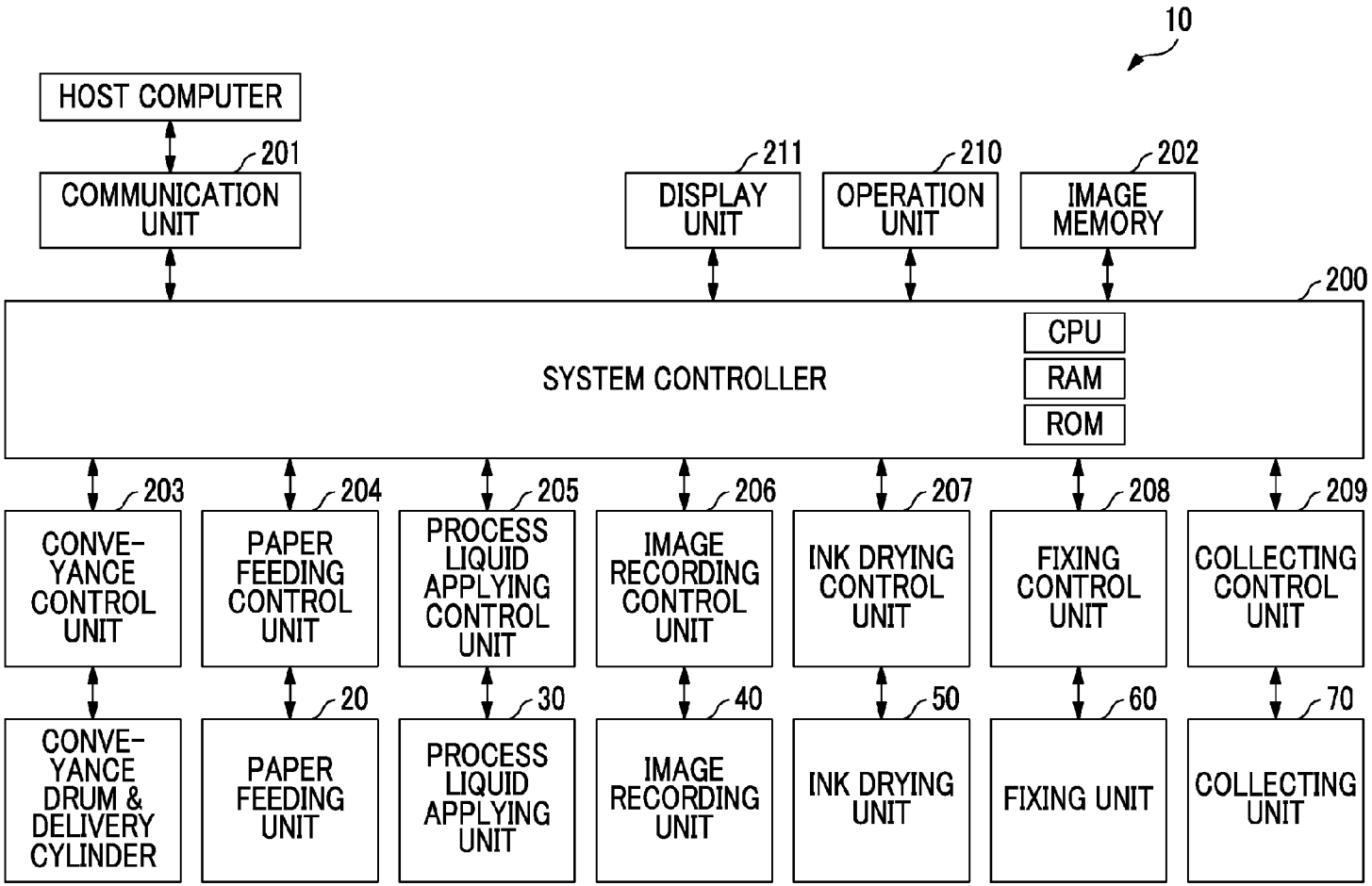
FIG. 2 is a block diagram illustrating a schematic configuration of a control system of the ink jet recording apparatus.

FIG. 2 is a block diagram illustrating a schematic configuration of a control system of the ink jet recording apparatus of the present embodiment.

As illustrated in the same drawing, the ink jet recording apparatus 10 includes a system controller 200, a communication unit 201, an image memory 202, a conveyance control unit 203, a paper feeding control unit 204, a process liquid applying control unit 205, an image recording control unit 206, an ink drying control unit 207, a fixing control unit 208, a collection control unit 209, an operation unit 210, a display unit 211 and the like.

The system controller 200 functions as a control unit for integrally controlling each unit of the ink jet recording apparatus 10 and functions as calculating means for performing various calculating processes. The system controller 200 includes a CPU, ROM, RAM and the like and is operated in accordance with a predetermined control program. The ROM stores the control program executed by the system controller 200 or various data required for the control.

The communication unit 201, having a communication interface required, performs transmission and reception of data to and from a host computer connected to the communication interface.

The image memory 202 functions as temporary storing means for various data including image data, and the data is written and read through the system controller 200. The image data captured from the host computer via the communication unit 201 is stored in the image memory 202.

The conveyance control unit 203 controls the conveyance drums 31, 41, 51 and 61 which are conveyance means for the paper Pin each unit of the process liquid applying unit 30, the image recording unit 40, the ink drying unit 50 and the fixing unit 60, and controls the drive of the delivery cylinders 80, 90 and 100.

That is, the conveyance control unit 203 controls the motor drive of the respective conveyance drums 31, 41, 51 and 61, and controls opening and closing of the grippers G provided at the respective conveyance drums 31, 41, 51 and 61.

Likewise, the conveyance control unit 203 controls the motor drive which drives the respective delivery cylinders 80, 90 and 100, and controls the opening and closing of the grippers G provided at the respective delivery cylinders 80, 90 and 100.

In addition, the respective conveyance drums 31, 41, 51 and 61 have a mechanism which adsorbs and holds the paper P on the peripheral surface. Accordingly, the conveyance control unit 203 controls the drive of the adsorbing and holding mechanism. That is, since the paper P is vacuum-adsorbed in the present embodiment, the conveyance control unit 203 controls the drive of a vacuum pump in a negative pressure generating means.

In addition, since the respective delivery cylinders 80, 90 and 100 include the dryers 84, 94 and 104, the conveyance control unit 203 controls the drive thereof (heating amount and air blowing amount).

The drive of the conveyance drums 31, 41, 51 and 61, and the drive of the delivery cylinders 80, 90 and 100 are controlled in response to a command from the system controller 200.

The paper feeding control unit 204 controls the drive of each unit (paper feeder 21, the delivery cylinder 23 and the like) configuring the paper feeding unit 20, in response to the command from the system controller 200.

The process liquid applying control unit 205 controls the drive of each unit (applying device 32 and the like) configuring the process liquid applying unit 30, in response to the command from the system controller 200.

The image recording control unit 206 controls the drive of each unit (press roller 42, the paper float detection sensor 43, the ink jet heads 44C, 44M, 44Y and 44K, the back tension provider 300 and the like) configuring the image recording unit 40, in response to the command from the system controller 200.

The ink drying control unit 207 controls the drive of each unit (ink dryer 52 and the like) configuring the ink drying unit 50, in response to the command from the system controller 200.

The fixing control unit 208 controls the drive of each unit (ultraviolet ray irradiating light source 62, the inline sensor 64 and the like) configuring the fixing unit 60, in response to the command from the system controller 200.

The collection control unit 209 controls the drive of each unit (paper output conveyer 72 and the like) configuring the collection unit 70, in response to the command from the system controller 200.

The operation unit 210, having a desired operation means (for example, an operation button, a key board, a touch panel or the like), outputs operation information input from the operation means to the system controller 200. The system controller 200 performs various processes in response to the operation information input from the operation unit 210.

The display unit 211, having a desired display device (for example, the LCD panel and the like), displays desired information on the display device in response to the command from the system controller 200.

As described above, the image data recorded on the paper is incorporated into the ink jet recording apparatus 10 from the host computer via the communication unit 201, and stored in the image memory 202. The system controller 200 executes a required signal process for the image data stored in the image memory 202 and generates dot data. The image which is represented by the image data is recorded on the paper by controlling the drive of the respective ink jet heads of the image recording unit 40, in accordance with the generated dot data.

The dot data is generally generated by performing a color conversion process and a halftone process with respect to the image data. The color conversion process is a process which converts the image data represented by sRGB and the like (for example, the image data of RGB 8 bits) to the ink amount data of each color of the inks used in the ink jet recording apparatus 10 (in this example, which converts to the ink amount data of each color, C, M, Y and K). The halftone process is the process which converts to the dot data of each color using a process such as error diffusion with respect to the ink amount data of each color, which is generated by the color conversion process.

The system controller 200 generates the dot data of each color by performing the color conversion process and the halftone process with respect to the image data. Then, the system controller 200 records the image represented by the image data on the paper, by controlling the drive of the corresponding ink jet head in accordance with the generated dot data of each color.

Printing Operation

Next, a printing operation by the above-described ink jet recording apparatus 10 will be briefly described.

If the command to feed the paper is output from the system controller 200 to the paper feeder 21, the paper P is fed from the paper feeder 21 to the paper feeding tray 22. The paper P fed to the paper feeding tray 22 is passed to the process liquid applying drum 31 of the process liquid applying unit 30 via the delivery cylinder 23.

The paper P passed to the process liquid applying drum 31 is conveyed by the process liquid applying drum 31 through a predetermined conveyance route and the process liquid is applied to the printing surface by the applying device 32 during the conveyance thereof.

The paper P to which the process liquid has been applied is passed from the process liquid applying drum 31 to the delivery cylinder 80. Then, the paper P is conveyed by the delivery cylinder 80 through a predetermined conveyance route and passed to the image recording drum 41 of the image recording unit 40. The paper P has the printing surface thereof exposed to the hot air from the dryer 84 disposed inside the delivery cylinder 80 during the conveyance course by the delivery cylinder 80, and the process liquid applied to the printing surface is dried.

The paper P passed from the delivery cylinder 80 to the image recording drum 41 is firstly nipped by the press roller 42 and the reverse surface is brought into contact with the outer peripheral surface of the image recording drum 41.

In the paper P passing through the press roller 42, the presence of the float is then detected by the paper float detection sensor 43. Here, if a float of the paper P is detected, the conveyance is stopped. On the other hand, in a case where the float is not detected, the paper P is conveyed toward the ink jet heads 44C, 44M, 44Y and 44K as it is. Then, when the paper P passes through the bottom of the respective ink jet heads 44C, 44M, 44Y and 44K, the ink droplets of each color, C, M, Y and K, are ejected from the respective ink jet heads 44C, 44M, 44 Y and 44K, and the color image is drawn on the printing surface.

The paper P on which the image is drawn is passed from the image recording drum 41 to the delivery cylinder 90. Then, the paper P is conveyed by the delivery cylinder 90 through a predetermined route and passed to the ink drying drum 51 of the ink drying unit 50. The paper P has the printing surface thereof exposed by the hot air from the dryer 94 disposed inside the delivery cylinder 90 during the conveyance course by the delivery cylinder 90, and the ink applied to the printing surface is dried.

The paper P passed to the ink drying drum 51 is conveyed by the ink drying drum 51 through a predetermined conveyance route. Then, the hot air is blown to the printing surface from the ink drier 52 during the conveyance course and the liquid component remaining on the printing surface is dried.

The paper P subjected to drying process is passed from the ink drying drum 51 to the delivery cylinder 100, then conveyed by the delivery cylinder 100 through a predetermined conveyance route, and passed to the fixing drum 61 of the fixing unit 60. The paper P has the printing surface thereof exposed by the hot air from the dryer 104 disposed inside the delivery cylinder 100 during the conveyance course by the delivery cylinder 100, and the ink applied to the printing surface is further dried.

The paper P passed to the fixing drum 61 is conveyed by the fixing drum 61 through a predetermined conveyance route, then the ultraviolet rays are irradiated to the printing surface during the conveyance course thereof, and the drawn image is fixed to the paper P. Thereafter, the paper P is passed from the fixing drum 61 to the paper output conveyer 72 of the collection unit 70, conveyed to the stacker 71 by the paper output conveyer 72 and output into the stacker 71.

As described above, in the ink jet recording apparatus 10 of this example, the paper P is conveyed using the drums, each process is executed for applying the process liquid, drying, landing of the ink droplets, drying and fixing with respect to the paper P during the conveyance course thereof, and a predetermined image is recorded on the paper P.

Details of Paper Conveyance Mechanism in Image Recording Unit

First Embodiment

Configuration

Figure 3:
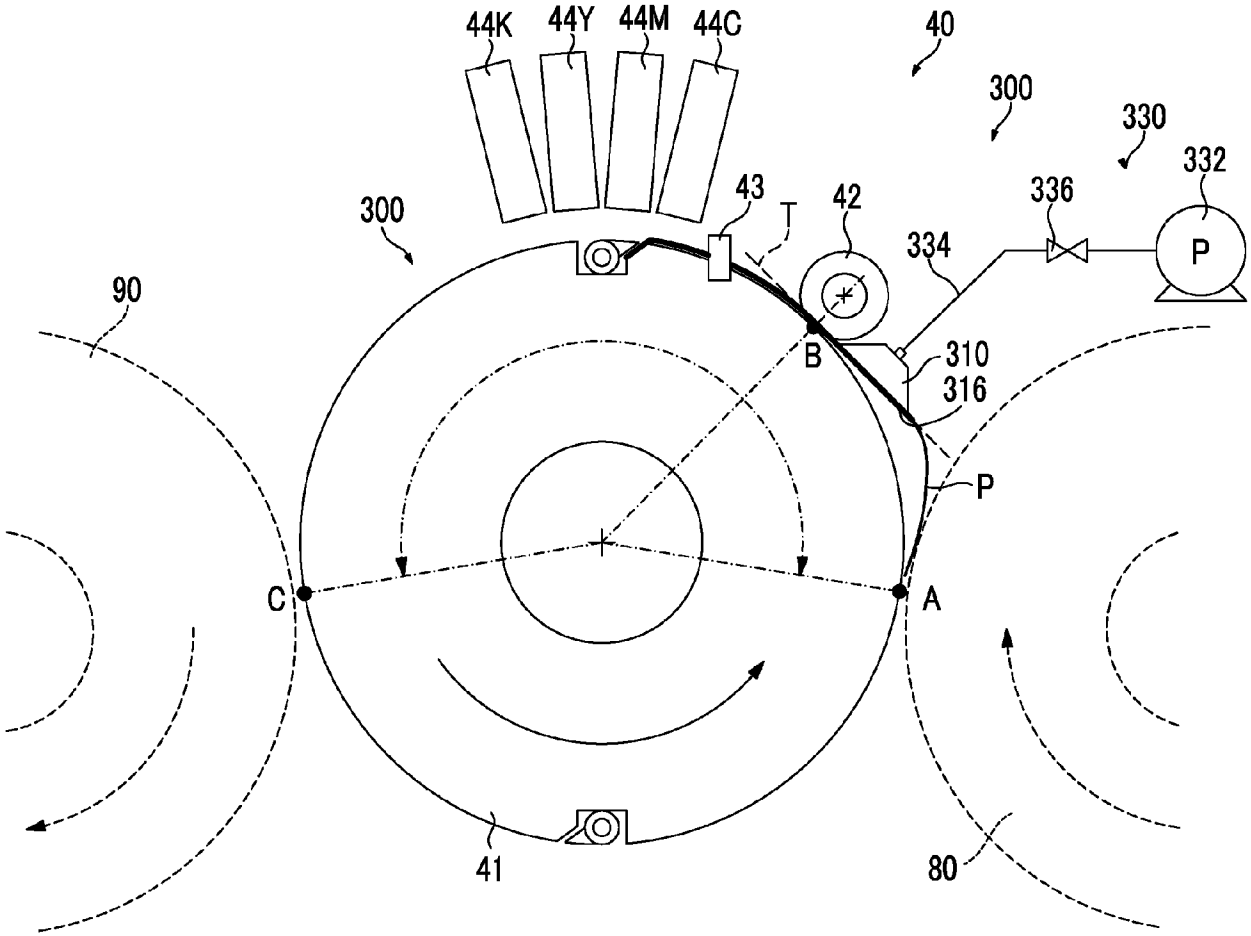
FIG. 3 is a side view illustrating a schematic configuration of a paper conveyance mechanism (paper conveyance apparatus) of an image recording unit.
Figure 4:
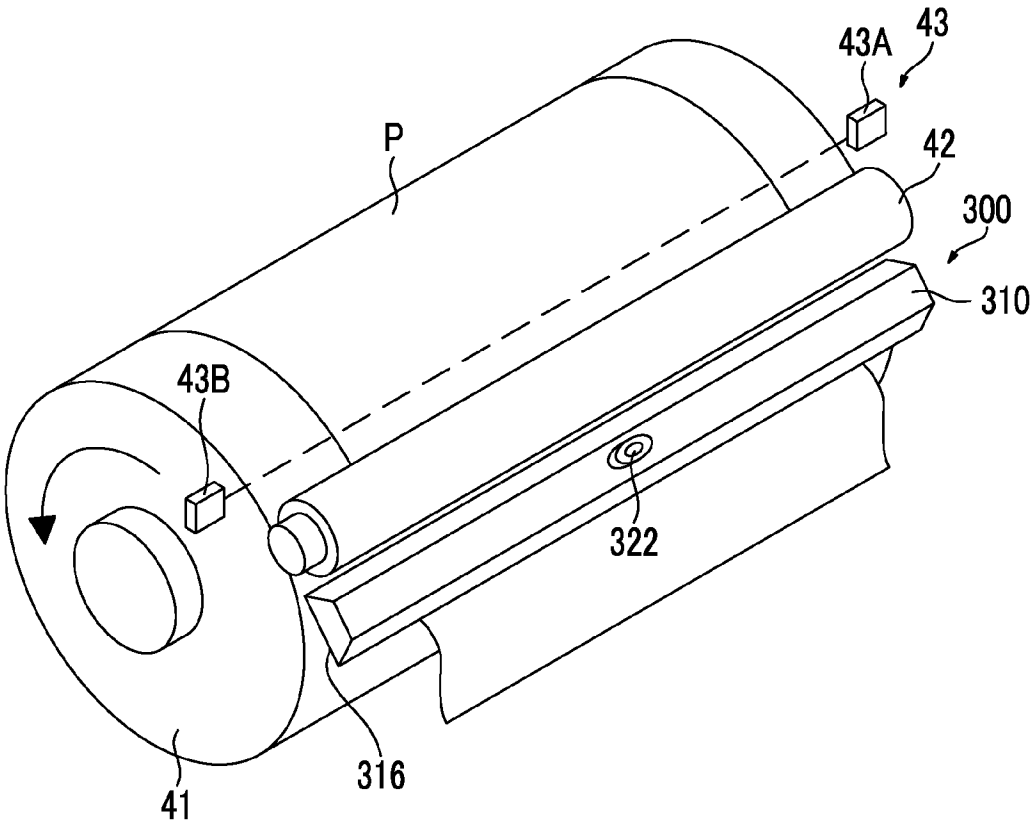
FIG. 4 is a perspective view illustrating a schematic configuration of the paper conveyance mechanism.
Figure 5:
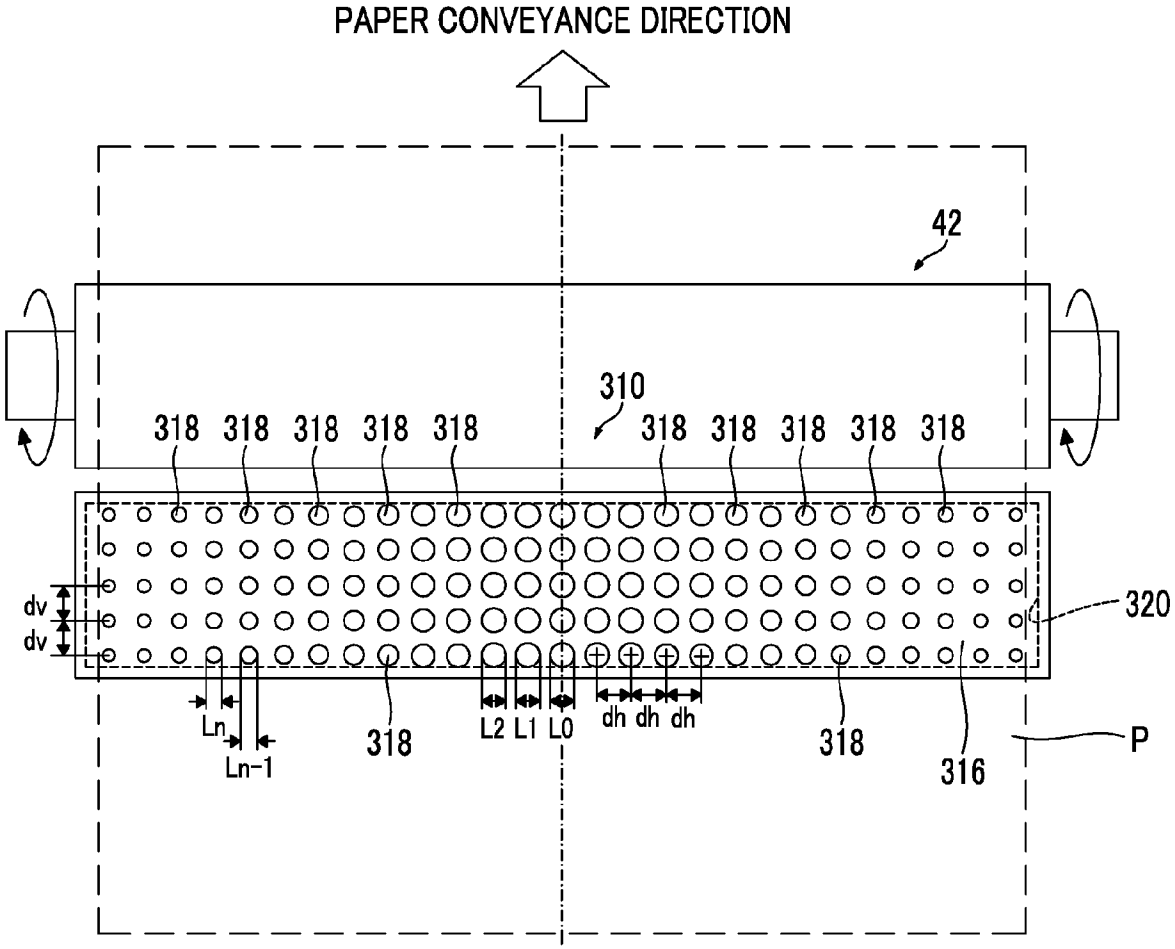
FIG. 5 is a bottom view of the paper conveyance mechanism.

FIG. 3 is a side view illustrating a schematic configuration of a paper conveyance mechanism (paper conveyance apparatus) of the image recording unit. In addition, FIG. 4 is a perspective view illustrating the schematic configuration of the paper conveyance mechanism. In addition, FIG. 5 is a bottom view of the paper conveyance mechanism.

As described above, the image recording unit 40 includes the image recording drum 41 which conveys the paper P, the press roller 42 which nips the paper P conveyed to the image recording drum 41 and brings it into close contact with the peripheral surface of the image recording drum 41, the paper float detection sensor 43 which detects a float of the paper P conveyed by the image recording drum 41, the ink jet heads 44C, 44M, 44Y and 44K which eject the ink droplets onto the paper P conveyed by the image recording drum 41, and the back tension provider 300 which provides the paper P with back tension by sucking the surface (printing surface) of the paper P at the position immediately before the press roller 42.

The image recording drum 41 receives the paper P conveyed by the delivery cylinder 80, at a predetermined receiving position, being rotated about the axis, and conveys the paper P along the arc-shaped conveyance route. At this time, the image recording drum 41 conveys the paper P while adsorbing and holding the paper P on the outer peripheral surface. That is, multiple adsorption holes are formed on the peripheral surface of the image recording drum 41, which sucks the air from the inside via the adsorption holes. Accordingly, the paper P wound around the outer peripheral surface is adsorbed and held.

Furthermore, in the image recording drum 41 of the present embodiment, the operating range of the adsorption is limited. The adsorption is operated only in the range from a predetermined adsorption start position B to an adsorption end position C. Here, the adsorption start position B is set to be the position leaving a constant distance from the receiving position A (position which is rotated by a constant angle), and the adsorption end position C is set to be the position where the paper P is passed to the delivery cylinder 90. Accordingly, after the paper P is conveyed to a constant distance from the receiving position A, the adsorption is started.

As illustrated in FIG. 4, the press roller 42 is placed at the upstream position of the ink jet heads with respect to the conveyance direction of the paper P. In this example, the press roller P is placed at the adsorption start position B.

The press roller 42 is configured by a rubber roller (here, a roller coated with rubber around a metal core (shank)) which has approximately the same width as the width of the image recording drum 41. The press roller 42 is placed in parallel to the image recording drum 41 (placed orthogonal to the conveyance direction of the paper P), both ends of the shaft thereof is pivotally supported on a bearing (not illustrated) and is supported to be freely rotatable. The bearing is biased toward the image recording drum 41 in a predetermined biasing force by a biasing mechanism (not illustrated; for example, a spring). As a result, the press roller 42 is pressed and brought into contact with the outer peripheral surface of the image recording drum 41, with a predetermined pressing force. In addition, accordingly, if the image recording drum 41 is rotated, the press roller 42 is rotated, being interlocked with the rotation of the image recording drum 41 (so-called accompanied rotation).

If the paper P passed to the image recording drum 41 at the receiving position is conveyed to the adsorption start position, the paper P is nipped by the press roller 42 and brought into close contact with the outer peripheral surface of the image recording drum 41. In addition, the suction is started at the same time.

The paper float detection sensor 43 detects a float of the paper P passing through the press roller 42. Therefore, the paper float detection sensor 43 is disposed in the rear of the press roller 42 (downstream side of the conveyance direction of the paper P by the image recording drum 41).

As illustrated in FIG. 4, the paper float detection sensor 43 is configured by the laser projector 43A which projects the laser beam and the laser receiver 43B which receives the laser beam.

The laser projector 43A projects the laser beam parallel to the axis of the image recording drum 41 from one end toward the other end in the width direction of the image recording drum 41, from the outer peripheral surface of the image recording drum 41 to a predetermined height position (upper limit height position of the allowable range of the float).

The laser receiver 43B is placed opposing the laser projector 43A across the travelling route of the paper P by the image recording drum 41, and receives the laser beam projected by the laser projector 43A. The laser receiver 43B detects the receiving amount of the received laser beams and outputs the detection result to the system controller 200.

The system controller 200 detects the float of the paper P based on the obtained information related to the receiving amount. That is, if the float equal to or more than the allowable value occurs in the paper P, the laser beam projected from the laser projector 43A is blocked by the paper P. As a result, the receiving amount of the laser beam received by the laser receiver 43B decreases. The system controller 200 determines that the float (float equal to or more than the allowable value) occurs, in a case where the receiving amount is equal to or less than the threshold value, by comparing the receiving amount of the laser beam received by the laser receiver 43B and the threshold value, and detects the float. Accordingly, it is possible to detect the float of the paper P.

When detecting a float equal to or more than the allowable value, the system controller 200 stops the rotation of the image recording drum 41 and stops the conveyance of the paper P. Accordingly, it is possible to prevent the paper P with the float from coming into contact with the nozzle surfaces of the ink jet heads.

Furthermore, the paper float detection sensor 43 is configured such that the height of the laser beam (height from the outer peripheral surface of the image recording drum 41) which is projected and received between the laser projector 43A and the laser receiver 43B can be adjusted. Accordingly, it is possible to arbitrarily set the allowable range of the float in response to the thickness and the like of the paper P.

The adjustment of the height of the projecting and receiving laser beam is performed, for example, by changing the height where the laser projector 43A and the laser receiver 43B are placed. In addition, a transparent parallel flat plate (for example, parallel flat glass plate) capable of adjusting an angle may be disposed in front of the laser projector 43A and the laser receiver 43B, and then refraction may be used. In this manner, it is possible to adjust the height of the projecting and receiving laser beam (if the transparent parallel flat plate is placed to be orthogonal with respect to the laser beam, the laser beam goes straight, but if the plate is displaced to be inclined, the laser beam is refracted during the incidence and exit, and thereby the adjustment of the height can be performed).

In addition, it is possible to eliminate unnecessary light and to perform a more accurate detection by disposing an aperture in front of the laser projector 43A and the laser receiver 43B.

As illustrated in FIG. 3, the back tension provider 300 sucks the surface of the paper P and provides the paper P with the back tension at the position (position immediately before the paper P enters between the image recording drum 41 and the press roller 42) immediately before the paper P conveyed by the image recording drum 41 is pressed by the press roller 42.

The back tension provider 300 is mainly configured by the paper guide 310 and a sucking unit 330.

Figure 6:
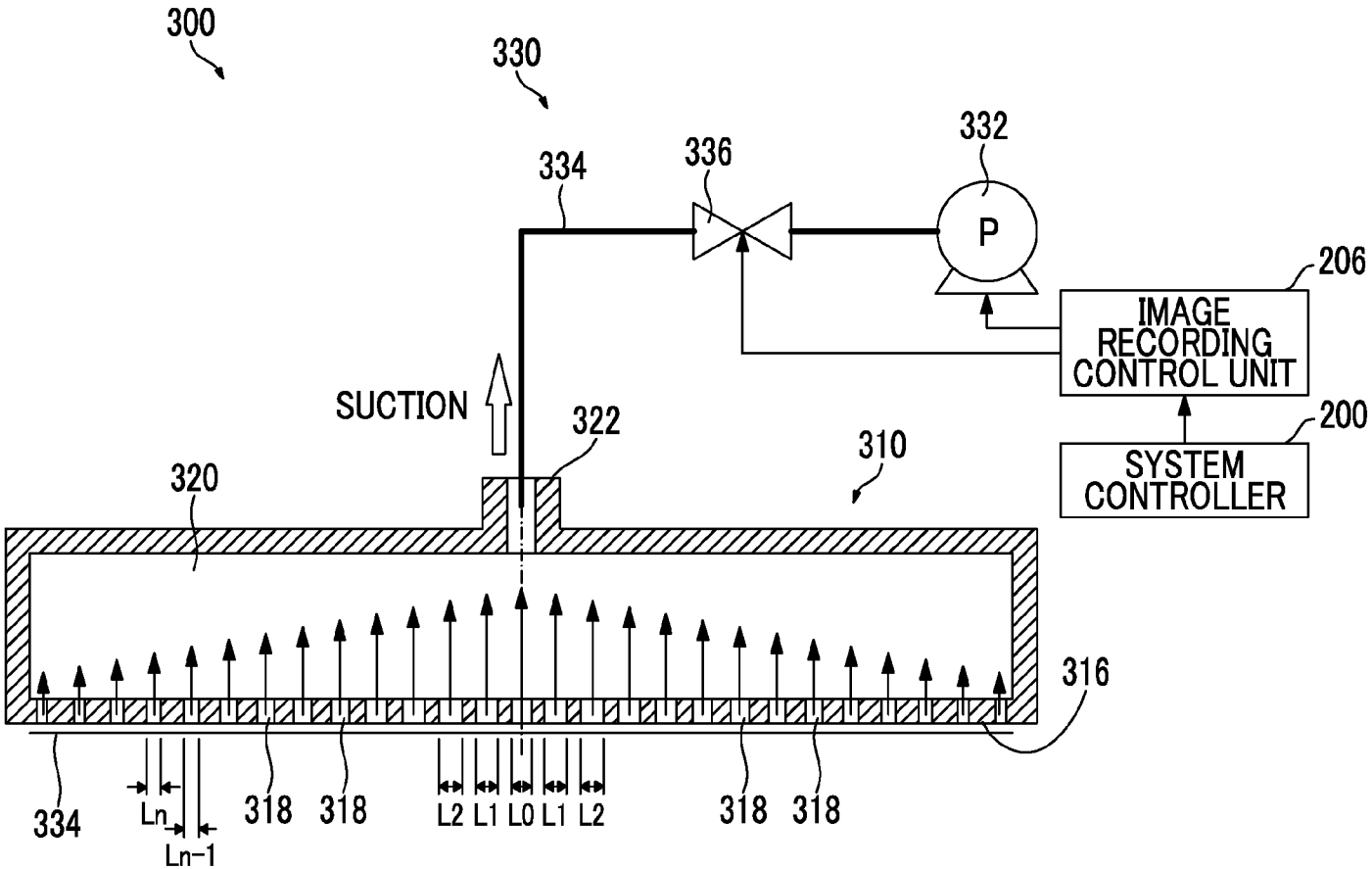
FIG. 6 is a schematic configuration diagram of a back tension provider.

FIG. 6 is a schematic configuration diagram of the back tension provider.

The paper guide 310 is formed such that the cross-section in the direction parallel to the conveyance direction of the paper P has a hollow box shaped in a trapezoidal shape (box shape widening toward the end). The paper guide 310 is formed corresponding to the width of the paper. Accordingly, the width thereof (width in the direction orthogonal to the conveyance direction of the paper P) is formed to be approximately the same as the width of the image recording drum 41.

In the paper guide 310, an adsorption surface 316 is formed on the surface opposing the image recording drum 41 in order to adsorb the paper P. The adsorption surface 316 is formed to be flat. The paper P slides on the adsorption surface while being sucked.

The paper guide 310 is disposed close to the press roller 42. Furthermore, in the present embodiment, the paper guide 310 is placed such that the adsorption surface 316 is along the tangent T of the image recording drum 41 in the disposal point of the press roller 42 (point with which the press roller 42 and the outer peripheral surface of the image recording drum 41 are in contact; in this example, the adsorption start position B). That is, the paper guide 310 is placed such that the disposal point of the press roller 42 is located on the extension line of the adsorption surface 316. Accordingly, it is possible to smoothly guide the paper P to between the image recording drum 41 and the press roller 42. Further, it is also possible to place the paper guide 310 such that the surface of the paper P comes near to be wound around the press roller 42.

As illustrated in FIG. 5, the adsorption surface 316 has multiple adsorption holes 318. The adsorption holes 318 are placed at a constant pitch (dv=constant) in the conveyance direction of the paper P and placed at a constant pitch (dh=constant) in the direction orthogonal to the conveyance direction (width direction of the adsorption surface 316) of the paper P. In addition, the adsorption holes 318 are formed such that the opening size becomes smaller as they go closer to both ends in the width direction of the adsorption surface 316. In this embodiment, each of the adsorption holes 318 is formed in a circle shape and formed such that the diameter becomes smaller as it goes toward both ends in the width direction from the center in the width direction of the adsorption surface 316. That is, for example, each of the adsorption holes 318 is formed such that the diameter of the adsorption hole (in a case of absence in the center, the adsorption hole placed at the closest position to the center) placed in the center in the width direction is set to be L0, and as it is separated from the center to both ends in the width direction, if the diameters are set to be L1, L2, . . . Ln, the relationship becomes L0>L1>L2> . . . >Ln.

Figure 7:
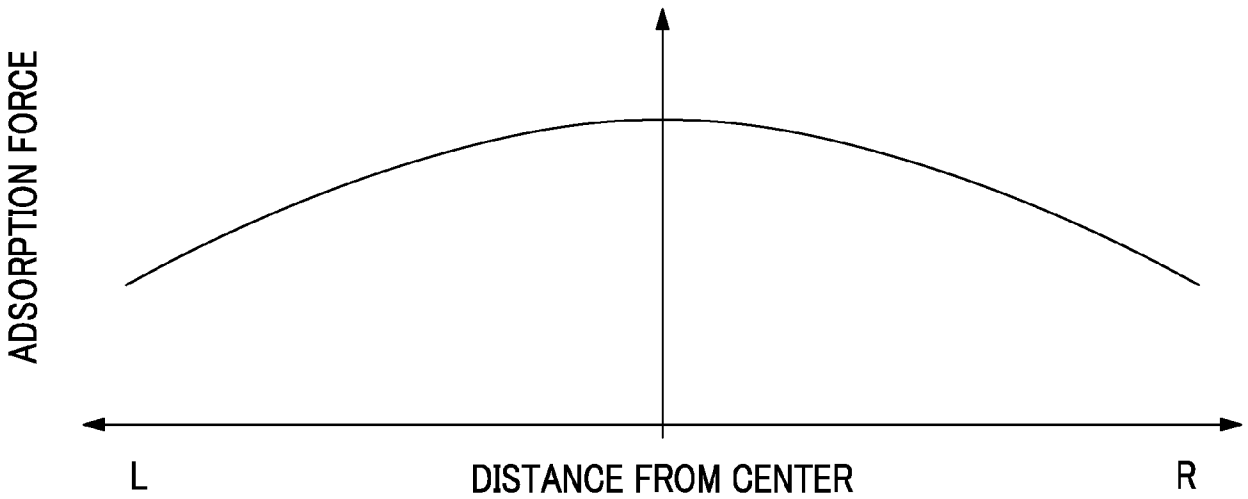
FIG. 7 is a graph illustrating distribution of an adsorption force acting on a paper.

Thus, the adsorption force acting on the paper P is distributed by forming the adsorption holes 318 such that the opening size becomes smaller from the center in the width direction toward both ends in the width direction of the adsorption surface 316. That is, as illustrated in FIG. 7, the adsorption holes are formed such that the adsorption force becomes weaker from the center in the width direction toward both ends in the width direction. Accordingly, when the paper is stretched by providing the paper P with the acting back tension, it is possible to stretch the paper P while the wrinkles are dispersed in the width direction.

Furthermore, each of the adsorption holes 318 is formed to have the same opening size in the direction along the conveyance direction of the paper P. In this example, those are formed in the same shape.

As described above, the paper guide 310 is formed in a hollow shape. The interior space of the paper guide 310 formed in the hollow shape is a suction chamber 320, which is formed with the approximately the same width as the width of the adsorption surface 316. Each of the adsorption holes 318 is formed so as to communicate with the suction chamber 320.

A suction port 322 is formed in the center portion on the upper surface (opposite side surface to the adsorption surface 316) of the paper guide 310. The suction port 322 communicates with the suction chamber 320. The suction chamber 320 is sucked by sucking the air from the suction port 322 and then the air is sucked from each of the adsorption holes 318 formed on the adsorption surface 316.

The suction unit 330 sucks the suction chamber 320 of the paper guide 310. The suction unit 330 includes a suction pump 332, a suction tube 334 and a suction valve 336.

The suction pump 332 is configured by a vacuum pump. The drive of the suction pump 332 is controlled by the system controller 200 via an image recording control unit 206.

The suction tube 334 connects the suction pump 332 and the paper guide 310. The suction tube 334 has one end connected to a suction inlet of the suction pump 332 and the other end connected to the suction port 322 of the paper guide 310.

The suction valve 336 is disposed in the middle of the conduit line of the suction tube 334. The suction valve 336 is formed such that the opening amount is adjustable. The opening amount of the suction valve 336 is controlled by the system controller 200 via the image recording control unit 206.

If the suction pump 332 is driven, the interior of the suction chamber 320 is sucked to be evacuated via the suction tube 334 (the inside of the suction chamber 320 comes to have a negative pressure). Accordingly, the air is sucked from each of the adsorption holes 318 formed on the adsorption surface 316.

Here, as described above, the adsorption holes 318 are formed on the adsorption surface 316 such that the opening size becomes smaller from the center in the width direction toward both ends in the width direction. Therefore, as illustrated in FIG. 7, the adsorption holes 318 are formed such that the adsorption force is distributed and the adsorption force becomes weaker as they go toward both ends in the width direction. Accordingly, it is possible to stretch the paper P while the wrinkles are dispersed in the width direction.

Furthermore, the adjustment of the entire suction force is performed by the suction valve 336. That is, the entire suction force is adjusted by adjusting the opening amount of the suction valve 336.

The back tension provider 300 is configured as above.

Action

As described above, the paper P is passed from the delivery cylinder 80 to the image recording drum 41. The image recording drum 41 receives the paper P from the delivery cylinder 80 at a predetermined receiving position A.

Receiving the paper P is performed by gripping the leading edge of the paper P using the grippers G. The image recording drum 41, being rotated, receives the paper P.

The paper P, the leading edge of which is gripped by the gripper G, is conveyed by the rotation of the image recording drum 41. Then, the surface (printing surface) of the paper P is pressed by the press roller 42 at the disposal position of the press roller 42, and the paper P is brought into close contact with the outer peripheral surface of the image recording drum 41.

Here, in the ink jet recording apparatus 10 of this example, the paper guide 310 is disposed in front of the press roller 42 (upstream side in the conveyance direction of the paper P).

Even though the adsorption surface 316 of the paper guide 310 is disposed apart from the outer periphery of the image recording drum 41, the air is sucked at the same time as the operation of the ink jet recording apparatus 10, from the adsorption holes 318 formed on the adsorption surface 316 (suction pump 332 is driven). As a result, the paper P to be conveyed by the image recording drum 41 has the surface (printing surface) adsorbed on the adsorption surface 316 at the position immediately before the paper P is pressed by the press roller 42, and is conveyed while being rubbed against the adsorption surface 316. Accordingly, the paper P is provided with back tension. Then, since the back tension is provided, the paper P is stretched in the conveyance direction and deformation (distortion) occurring on the paper P is removed.

Figure 8:
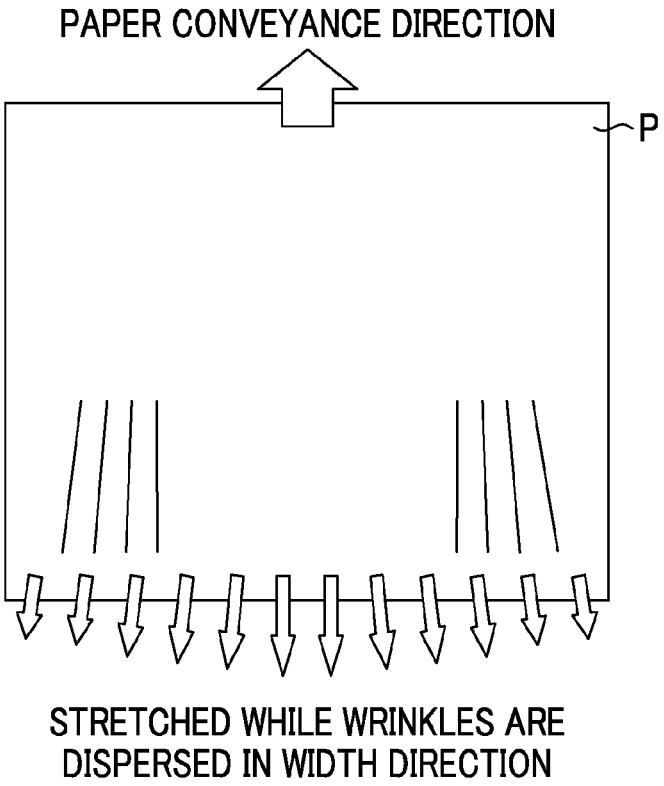
FIG. 8 is a conceptual diagram of an action due to a back tension.

Incidentally, as described above, the back tension is provided by sucking the surface of the paper P using the adsorption surface 316. However, the adsorption force of the adsorption surface 316 is not uniform, but the distribution thereof is spread in the width direction. That is, as illustrated in FIG. 7, the adsorption force is set to become weaker as it goes from the center in the width direction toward both ends in the width direction. As illustrated in FIG. 8, it is possible to stretch the deformation occurring in the paper P while it is dispersed in the width direction by setting the adsorption force in this manner. Accordingly, it is possible to prevent the wrinkles from being accumulated in the rear of the paper P.

The paper P enters between the press roller 42 and the image recording drum 41 in a state of being provided with the back tension by the back tension provider 300. Then, the surface is pressed by the press roller 42 and the paper P is wound around the outer peripheral surface of the image recording drum 41. Since the paper P is pressed by the press roller 42 in a state of being tightly stretched by the provided back tension, it is possible to bring the paper P into close contact with the peripheral surface of the image recording drum 41 without causing wrinkles or floats.

The image recording drum 41 operates the suction from the disposal point of the press roller 42. Therefore, the paper P has the reverse surface adsorbed on the outer peripheral surface of the image recording drum 41 at the same time as being pressed by the press roller 42.

Thereafter, the paper P passes through the paper float detection sensor 43, which detects the presence of a float. In a case where the float is not detected, the paper P is conveyed as it is and the image recording is performed. That is, when the paper P passing through each of the ink jet heads 44C, 44M, 44Y and 44K, the ink droplets are ejected onto the surface from each of the ink jet heads 44C, 44M, 44Y and 44K and thereby the image is recorded on the surface.

As described above, according to the paper conveyance mechanism of the present embodiment, when the back tension is provided by sucking the surface of the paper P, the adsorption force is distributed. Therefore, it is possible to stretch the paper P while the wrinkles are dispersed in the width direction. Accordingly, without causing wrinkles or floats, the paper P can be wound around the peripheral surface of the image recording drum 41. Consequently, it is possible to stably record a high-quality image. In addition, it is possible to stably convey the paper P without being brought into contact with the heads.

In addition, the paper conveyance mechanism of the present embodiment has a configuration where the surface of the paper P is sucked. Accordingly, for example, even in a case where the image has been already recorded on the reverse surface of the paper P subjected to the printing process, it is possible to convey the paper P without the image being impaired.

Figure 9A:
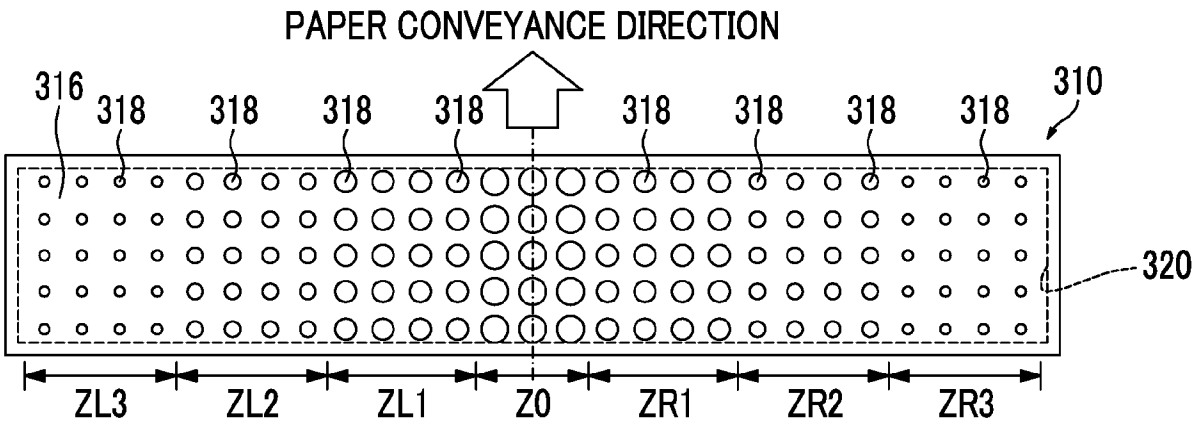
FIGS. 9A and 9B illustrate another embodiment (modification example) of an adsorption surface.

Furthermore, in the above-described embodiment, there is an aspect where the opening size of the adsorption holes 318 formed on the adsorption surface 316 gradually is decreased toward both ends, but may be decreased in stages. For example, as illustrated in FIG. 9A, the adsorption surface 316 may be divided into a plurality of zones ZL3, ZL2, ZL1, Z0, ZR1, ZR2 and ZR3 in the width direction, and the opening size may be decreased in stages for each zone. In the example illustrated in the same drawing, the opening size of the adsorption holes 318 placed at the center zone Z0 is formed to be the largest and as it is apart from the center, the opening size is formed to be gradually decreased (ZL1>ZL2>ZL3, ZR1>ZR2>ZR3, ZL1=ZR1, ZL2=ZR2, ZL3=ZR3).

Figure 9B:
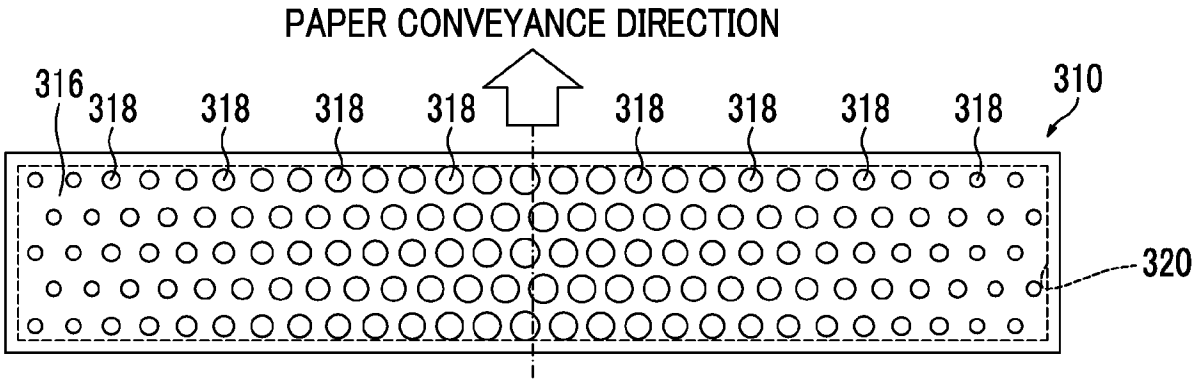

In addition, in the above-described embodiment, the adsorption holes 318 are placed at equal intervals (interval between the centers of adsorption holes placed back and forth is equal). However, as illustrated in FIG. 9B, they may be configured to be placed in zigzags (alternately).

Figure 10A:
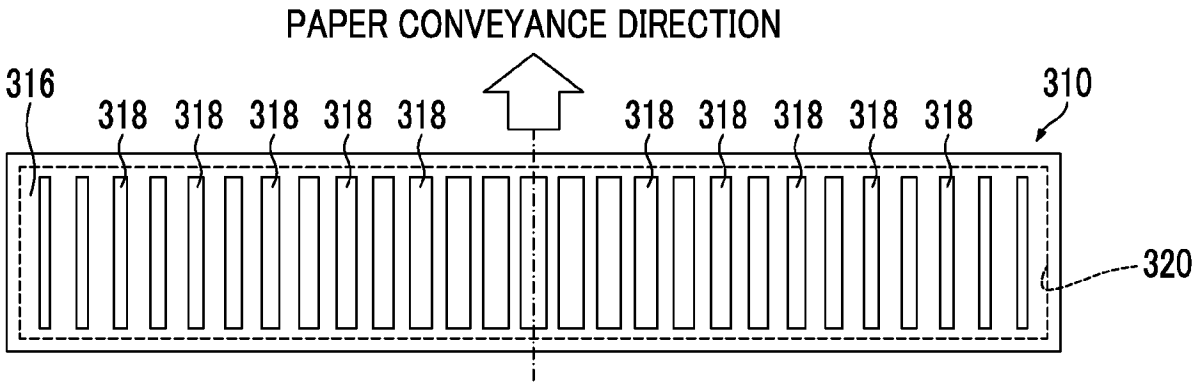
FIGS. 10A and 10B illustrate another embodiment (modification example) of the adsorption surface.
Figure 10B:
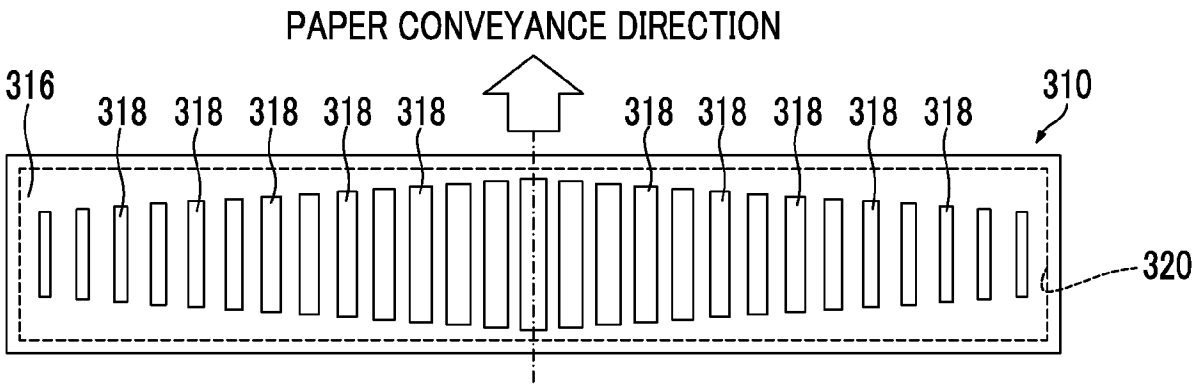

In addition, in the above-described embodiment, the adsorption holes 318 are configured to be circular and to be arranged in a predetermined pattern, but the shape of the adsorption holes 318 is not limited thereto. For example, as illustrated in FIGS. 10A and 10B, the adsorption holes 318 with a slit shape may be formed. In this case, as illustrated in FIG. 10A, the adsorption holes 318 with the slit shape of the same length along the conveyance direction of the paper P may be formed at a constant pitch in the width direction, and may be formed such that the width is gradually decreased from the center in the width direction toward both ends in the width direction. In addition, as illustrated in FIG. 10B, the adsorption holes 318 with the slit shape along the conveyance direction of the paper P may be formed at a constant pitch, and may be formed such that the width and the length are gradually decreased from the center in the width direction toward both ends in the width direction.

Figure 11A:
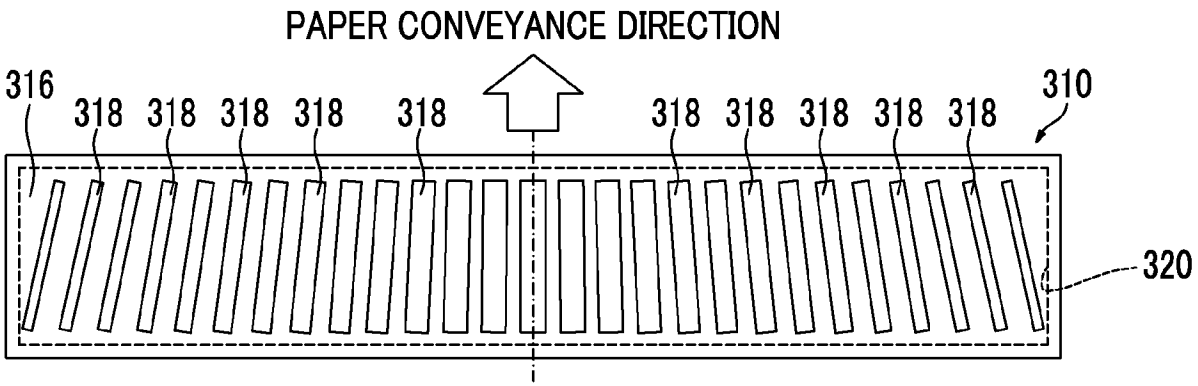
FIGS. 11A to 11C illustrate another embodiment (modification example) of the adsorption surface.

In addition, as illustrated in FIG. 11A, the adsorption holes 318 with the slit shape may be formed at a constant pitch in the width direction and may be formed such that the width is gradually decreased from the center in the width direction toward both ends in the width direction. And then, tip end side in the conveyance direction of the paper P may be formed to be gradually tilted toward the center in the width direction. This allows the adsorption to be started from the center in the width direction and thereby the wrinkles can be efficiently diffused.

Figure 11B:
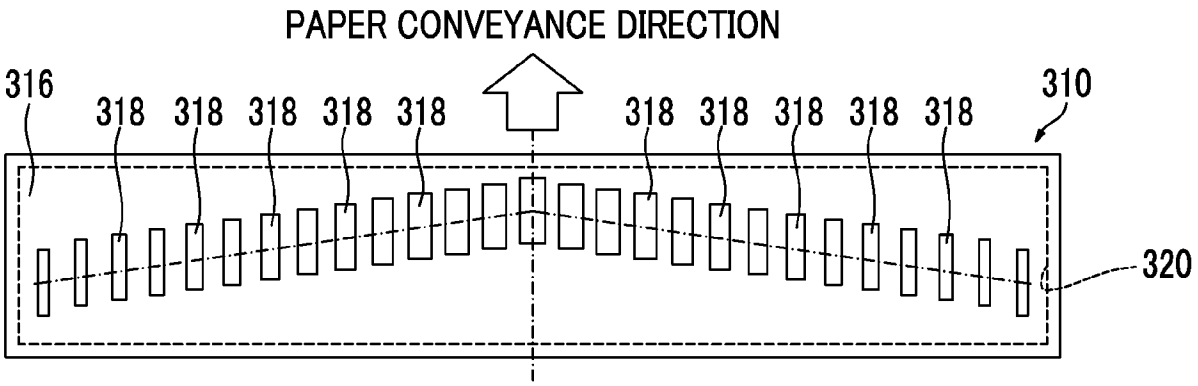
Figure 11C:
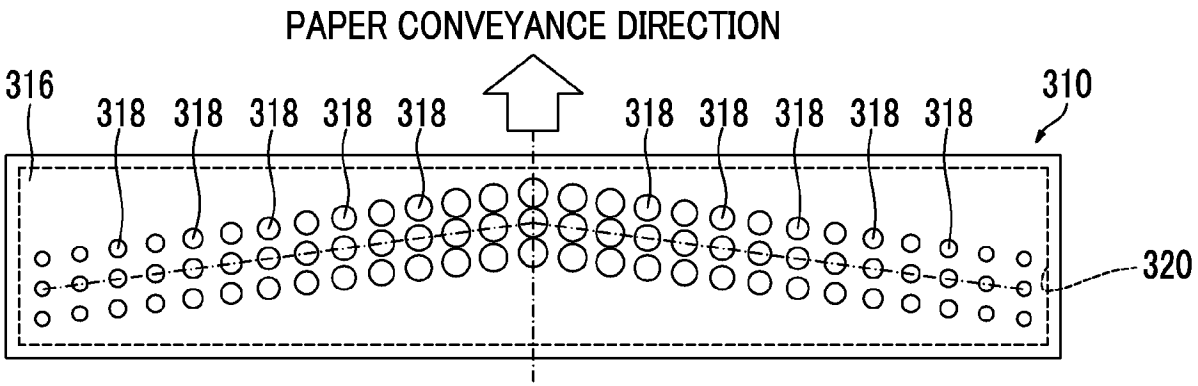

In addition, as illustrated in FIG. 11B, the adsorption holes 318 with the slit shape may be placed at a constant pitch on a straight line extending to the rear of both ends from the center in the width direction, and may be formed such that the width is gradually decreased from the center in the width direction toward both ends in the width direction. This configuration also allows the adsorption to be started from the center in the width direction and thereby the wrinkles can be efficiently diffused. Further, as illustrated in FIG. 11C, it is possible to obtain the same effect even with circular adsorption holes 318 instead of the slit-shaped adsorption holes 318. That is, the circular adsorption holes 318 are placed at a constant pitch on the straight line extending to the rear of both ends from the center in the width direction, and may be formed such that the diameter is gradually decreased from the center in the width direction toward both ends in the width direction. In this case, as illustrated in the same drawing, a plurality of the adsorption holes 318 is placed along the conveyance direction of the paper P.

Figure 12:
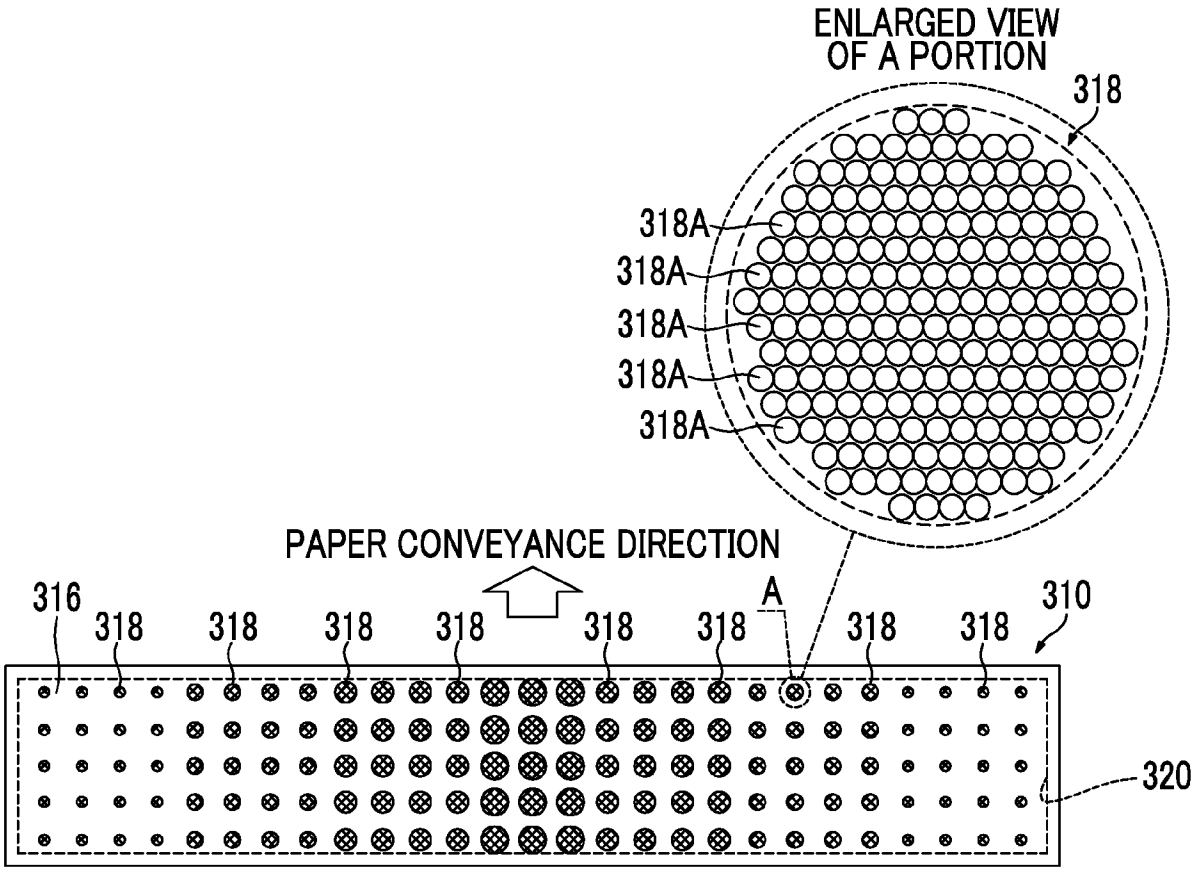
FIG. 12 illustrates another embodiment (modification example) of the adsorption surface.

In addition, in the above-described embodiment, the respective adsorption holes 318 are formed by one hole each. However, as illustrated in FIG. 12, the respective adsorption holes 318 may be formed by gathering a plurality of small diameter holes 318A. In the example illustrated in the same drawing, a plurality of small diameter holes 318A forms the circular adsorption holes 318. In this manner, since the respective adsorption holes 318 are formed by gathering a plurality of the small diameter holes 318A, it is possible to prevent the paper P from being deformed along the adsorption holes and traces of the adsorption holes remaining thereon.

Other Aspect to Form Adsorption Holes

The above-described embodiment is configured to obtain desired distribution of the adsorption force by changing the opening size of the individual adsorption holes arranged in the width direction. However, the configuration distributing the adsorption force is not limited thereto. That is, in a case where a single suction chamber sucks, if the adsorption holes 318 are formed such that the opening ratio (ratio of the opening size) is decreased from the center in the width direction toward both ends in the width direction, it is possible to distribute the adsorption force. Therefore, even in a case where the adsorption holes having the same opening size are formed, if the disposal interval is changed, it is possible to distribute the adsorption force on the same adsorption surface.

Figure 13:
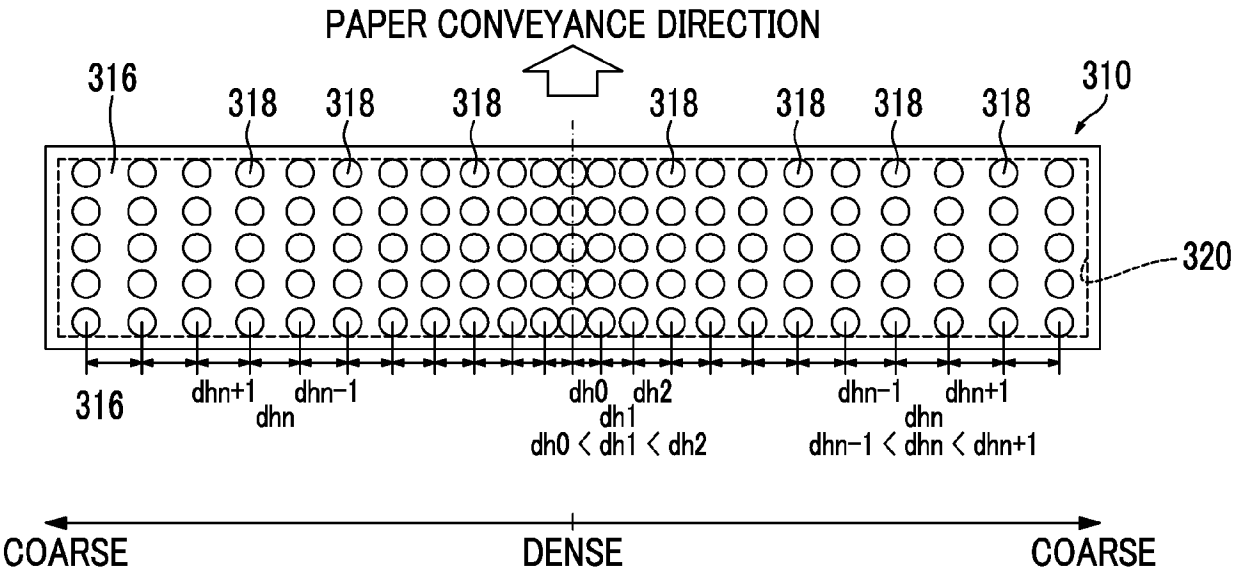
FIG. 13 illustrates another embodiment (modification example) of the adsorption surface.

FIG. 13 is a plan view of the adsorption surface in a case where the adsorption force is distributed by adjusting the disposal interval of the adsorption holes.

As illustrated in the same drawing, the respective adsorption holes 318 are formed to have the same size, but are densely placed in the center in the width direction and coarsely placed as they go toward both ends in the width direction. That is, as they go from the center in the width direction toward both ends in the width direction, the adsorption holes 318 are placed such that the interval dhn of the adsorption holes adjacent to each other becomes wider (dhn−1<dhn). By adjusting the interval of the adsorption holes adjacent to each other in the width direction in this manner (=adjusting a placement density of the adsorption holes in the width direction), it is possible to distribute the adsorption force (it is possible to form them such that the adsorption force is decreased from the center in the width direction toward both ends in the width direction).

Figure 14A:
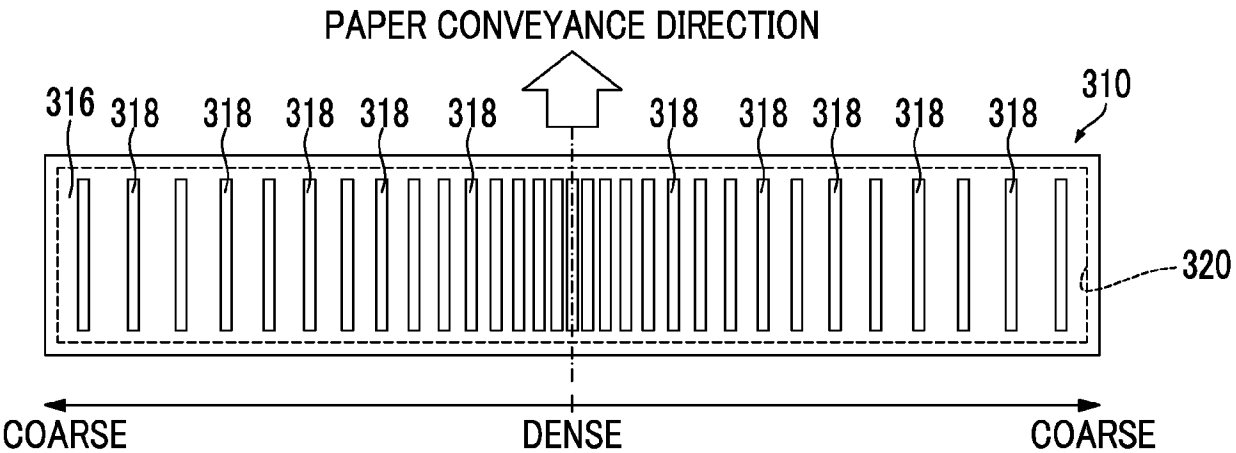
FIGS. 14A and 14B illustrates another embodiment (modification example) of the adsorption surface.
Figure 14B:
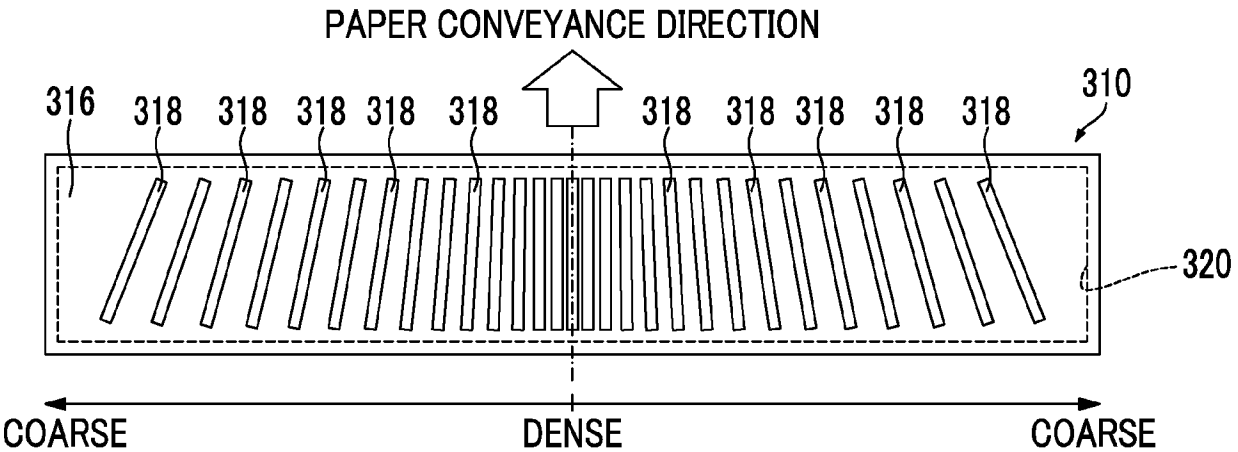

FIGS. 14A and 14B are plan views of the adsorption surface in a case of forming the adsorption holes with the slit shape. As illustrated in FIG. 14A, the adsorption holes with the slit shape (formed in the direction extending to the conveyance direction of the paper) are arranged along the width direction, and the adsorption holes are placed such that the interval of the adsorption holes adjacent to each other gradually becomes wider from the center in the width direction toward both ends in the width direction. Even in this case, it is possible to form them such that the adsorption force is decreased from the center in the width direction toward both ends in the width direction. FIG. 14B illustrates that the adsorption holes with the slit shape are arranged along the width direction, placed such that the interval of the adsorption holes adjacent to each other gradually becomes wider from the center in the width direction toward both ends in the width direction, and are formed from the center in the width direction toward both ends in the width direction of the paper P such that the tip end sides in the conveyance direction of the paper P are gradually tilted toward the center in the width direction. Accordingly, the adsorption is started from the center in the width direction and thereby the wrinkles can be efficiently diffused.

In addition to this, it is possible to distribute the adsorption force even by adjusting the interval of the adsorption holes adjacent to each other for each zone (=even by adjusting the placement density of the adsorption holes for each zone).

Figure 15:
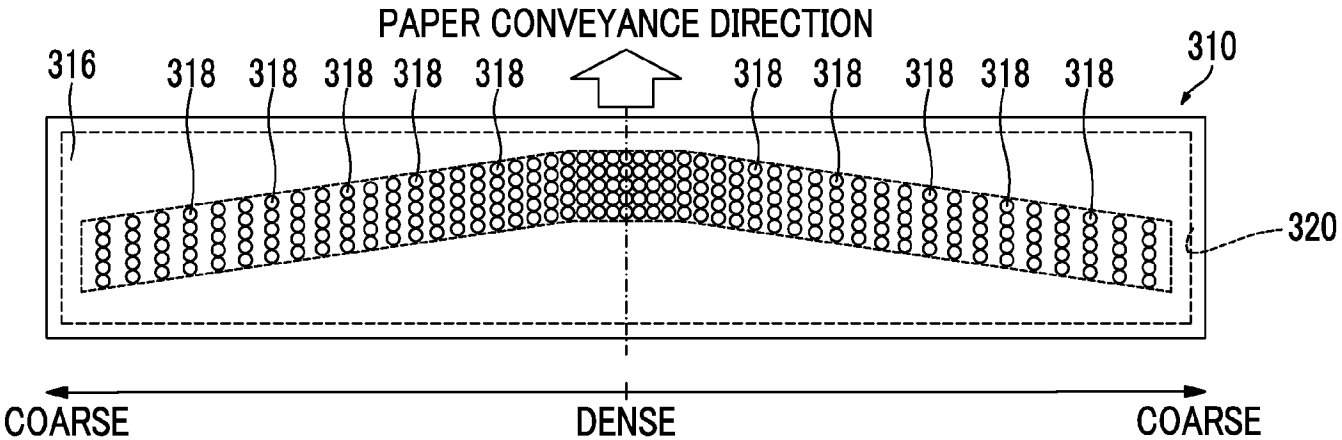
FIG. 15 illustrates another embodiment (modification example) of the adsorption surface.

In addition, as illustrated in FIG. 15, the adsorption holes 318 may be placed on the straight line extending to the rear ends of both ends from the center in the width direction, and may be formed such that the interval of the adsorption holes adjacent to each other gradually becomes wider. This configuration also allows the adsorption to be started from the center in the width direction and thereby the wrinkles can be efficiently diffused.

Furthermore, by adjusting the interval (placement density of the adsorption holes in the width direction) of the adsorption holes adjacent to each other in this manner, it is possible to form the respective adsorption holes by gathering a plurality of the small diameter holes (refer to FIG. 12), similarly to the above description, even in a case of adjusting the adsorption force. Accordingly, it is possible to prevent the paper P from being deformed along the adsorption holes and the traces of the adsorption holes remaining.

Other Aspect

In the above-described embodiment, an example where the adsorption surface 316 is integrally formed with the paper guide 310 is described. However, the adsorption surface 316 may be formed to be replaceable (configured such that a part configuring the adsorption surface 316 is attachable, detachable and replaceable) such that the distribution of the adsorption force to act depending on the paper is changed.

Figure 16A:
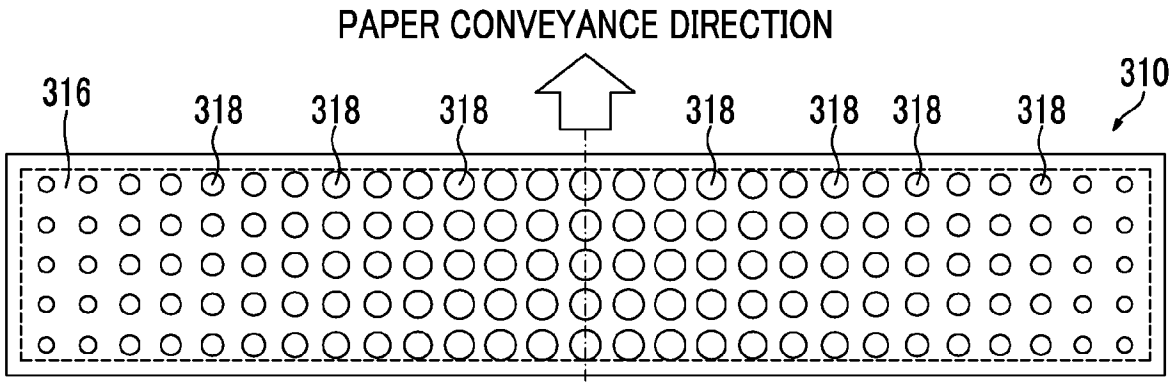
FIGS. 16A to 16C illustrates another embodiment (modification example) of a paper guide.
Figure 16B:
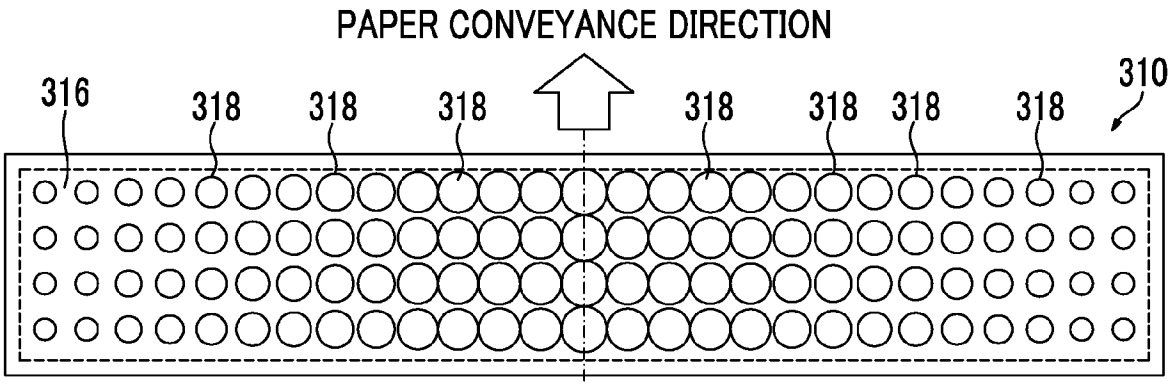
Figure 16C:
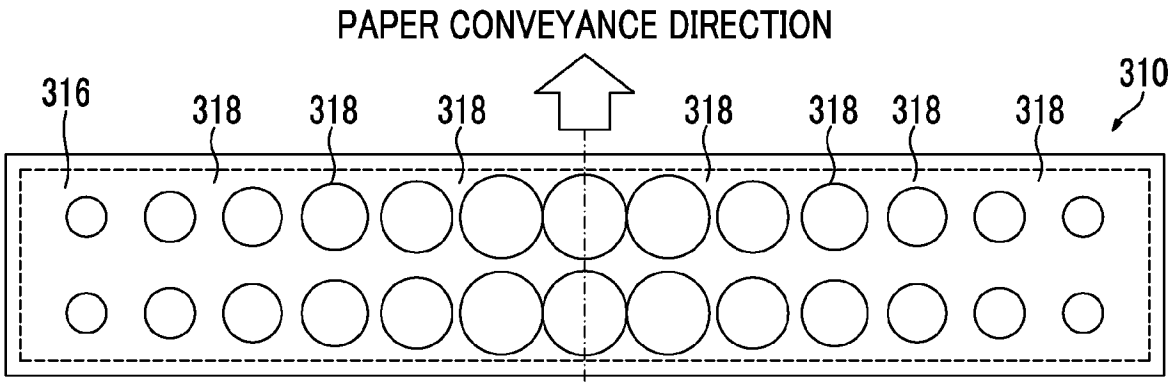

For example, as illustrated in FIGS. 16A to 16C, a plurality of the adsorption surfaces which has a different size, arrangement and the like of the adsorption holes may be prepared such that the adsorption surface to be used can be replaced depending on a type, thickness, air permeability, whether or not the paper is printed, and the like of the paper P. Accordingly, the adsorption force can appropriately act depending on the paper P and thereby it is possible to more efficiently prevent the occurrence of wrinkles or floats.

In addition to this, the respective adsorption holes are formed to be expandable and contractible (for example, to provide an adjusting mechanism of the opening size, such as an iris mechanism) so as to adjust the opening size depending on the paper. Even in this case, the same effect can be obtained.

In addition, the above-described embodiment has a configuration where the distribution of the adsorption force is adjusted by adjusting the opening size of the adsorption holes or the formation interval of the adsorption holes. However, the distribution of the adsorption force may be adjusted by adjusting both of the opening size of the adsorption holes and the formation interval of the adsorption holes.

Second Embodiment

In the above-described first embodiment, the opening ratio of the adsorption surface by adsorption holes is adjusted and thereby the adsorption force is decreased from the center in the width direction toward both ends in the width direction.

In the present embodiment, a suction chamber is divided into a plurality of chambers and distribution of the adsorption force is adjusted by adjusting the suction force of each chamber.

Figure 17:
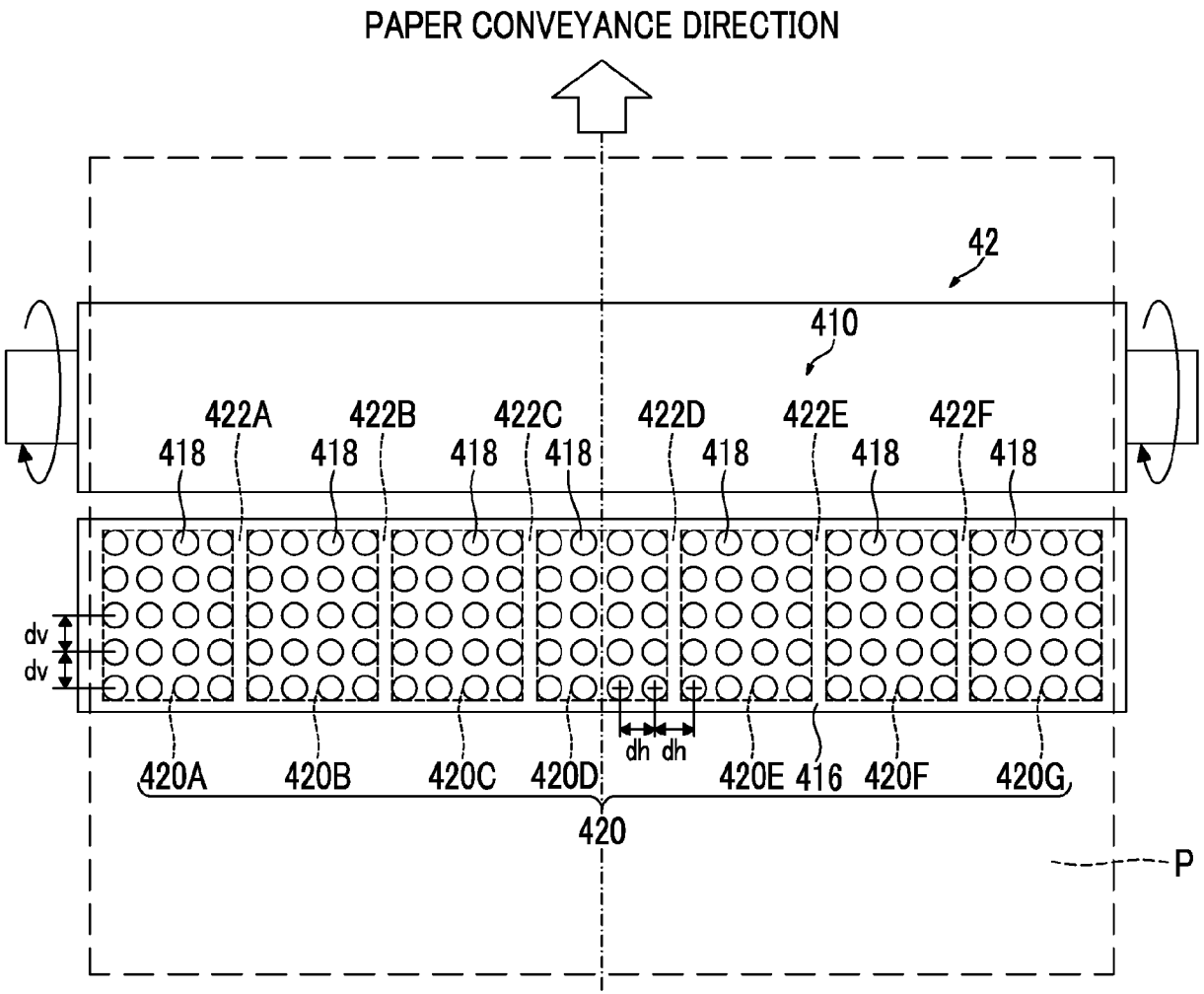
FIG. 17 is a bottom view of a second embodiment of the paper conveyance mechanism of the image recording unit.
Figure 18:
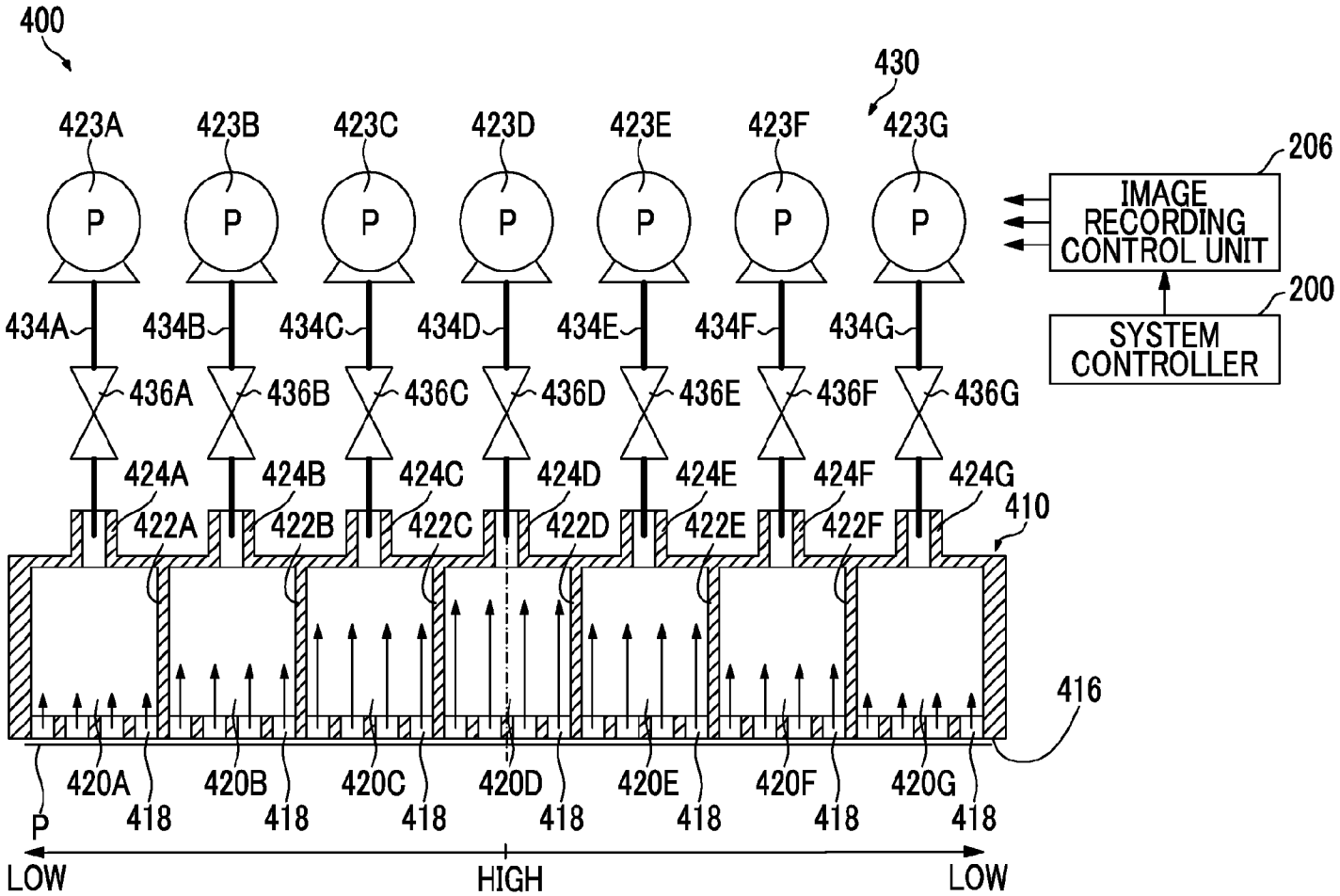
FIG. 18 is a schematic configuration diagram of a back tension provider to be incorporated in a paper conveyance mechanism of the second embodiment.

FIG. 17 is a bottom view of a second embodiment of a paper conveyance mechanism of an image recording unit. In addition, FIG. 18 is a schematic configuration diagram of a back tension provider to be incorporated in the paper conveyance mechanism of the second embodiment.

Furthermore, a configuration other than the back tension provider is the same as that of the paper conveyance mechanism of the above-described first embodiment. Accordingly, herein, only the back tension provider will be described.

The back tension provider (back tension providing unit) 400 of the present embodiment is also mainly configured by a paper guide 410 and a suction unit 430.

The paper guide 410 is formed such that the cross-section in the direction parallel to the conveyance direction of the paper P has a hollow box shaped in a trapezoidal shape (box shape widening toward the end). The paper guide 410 is formed corresponding to the width of the paper. Accordingly, the width thereof (width in the direction orthogonal to the conveyance direction of the paper P) is formed to be approximately the same as the width of the image recording drum 41.

In the paper guide 410, an adsorption surface 416 is formed on the surface opposing the image recording drum 41 in order to adsorb the paper P. The adsorption surface 416 is formed to be flat. The paper P slides on the adsorption surface while being sucked.

Similarly to the above-described first embodiment, the paper guide 410 is disposed close to the press roller 42. In addition, an adsorption surface 416 is placed so as to be along the tangent of the image recording drum 41 in the disposal point of the press roller 42 (refer to FIG. 4).

As illustrated in FIG. 17, multiple adsorption holes 418 are formed on the adsorption surface 416. The respective adsorption holes 418 are formed in the same shape (formed with the same opening size). In addition, the respective adsorption holes 418 are placed at a constant pitch (dv=constant) in the conveyance direction of the paper P and placed at a constant pitch (dh=constant) in the direction orthogonal to the conveyance direction (width direction of the adsorption surface 416) of the paper P. That is, the adsorption holes 418 with the same size are equally placed on the entire surface of the adsorption surface 416.

The interior space of the paper guide 410 is a suction chamber 420, which is formed with the approximately the same width as the width of the adsorption surface 416. Each of the adsorption holes 418 is formed so as to communicate with the suction chamber 420.

The suction chamber 420 is divided into a plurality of chambers 420A to 420G by a plurality of division walls 422A to 422F. The division walls 422A to 422F are placed along the conveyance direction of the paper P (placed in the direction orthogonal to the width direction of the adsorption surface), and divides the suction chamber 420 into a plurality of the chambers 420A to 420G along the width direction. In this example, the suction chamber 420 is divided into seven chambers 420A to 420G by six division walls 422A to 422F, and the chambers 420A to 420G are symmetrically placed.

The respective chambers 420A to 420G are formed with the same size and are formed independently of each other. The adsorption holes 418 formed on the adsorption surface 416 communicate with any one of the chambers 420A to 420G. That is, the adsorption holes 418 placed on a formation region of the respective chambers 420A to 420G individually communicate with the respective chambers 420A to 420G. Accordingly, for example, the adsorption holes 418 placed on the formation region of the chamber 420A communicate with only the chamber 420A.

Individual suction ports 424A to 424G are formed on the upper surface (opposite side surface to the adsorption surface 416) of the paper guide 410, corresponding to the respective chambers 420A to 420G. Individual suction ports 424A to 424G individually communicate with the corresponding chambers 420A to 420G. The respective chambers 420A to 420G are individually sucked by sucking the air from the individual suction ports 424A to 424G and then the air is sucked from the adsorption holes 418 corresponding to the respective chambers 420A to 420G.

A suction unit 430 individually sucks the respective chambers 420A to 420B of the paper guide 410. The suction unit 430 includes individual suction pumps 432A to 432G provided at each chamber, individual suction tubes 434A to 434G provided at each chamber, and individual suction valves (individual valves) 436A to 436G provided at each of the individual suction tubes 434A to 434G.

The individual suction pumps 432A to 432G are configured by vacuum pumps. The drive of each of the individual suction pumps 432A to 432G is controlled by the system controller 200 via the image recording control unit 206.

The individual suction tubes 434A to 434G connect the individual suction pumps 432A to 432G and the respective chambers 420A to 420G of the paper guide 410. In each of the individual suction tubes 434A to 434G, one end is connected to the inlet port of the individual suction pumps 432A to 432G and the other end is connected to the individual suction ports 424A to 424G provided corresponding to the respective chambers 420A to 420G.

The individual suction valves 436A to 436G are disposed in the middle of the conduit line of each of the individual suction tubes 434A to 434G. Each of the individual suction valves 436A to 436G is formed such that the opening amount is adjustable. The opening amount of each of the individual suction valves 436A to 436G is controlled by the system controller 200 via the image recording control unit 206.

If each of the individual suction pumps 432A to 432G is driven, the interior of the respective chambers 420A to 420G is sucked to be evacuated via each of the individual suction tubes 434A to 434G (the inside of the respective chambers 420A to 420G comes to have the negative pressure). Accordingly, the air is sucked from each of the adsorption holes 418 formed on the adsorption surface 416.

Here, in the individual suction tubes 434A to 434G which link each of the individual suction pumps 432A to 432G with the respective chambers 420A to 420G, each of the individual suction valves 436A to 436G is individually provided. Thus, it is possible to individually control the suction force of the respective chambers 420A to 420G by individually controlling the opening amount of the individual suction valves 436A to 436G. Then, it is possible to control the suction force from the adsorption holes 418 communicating with the respective chambers 420A to 420G by individually controlling the suction force of the respective chambers 420A to 420G. Accordingly, it is possible to control the adsorption force acting on the paper P to a different value in the width direction by adjusting the suction force of the respective chambers 420A to 420G.

As described above, the adsorption force acting on the paper P on the adsorption surface 416 is set to be decreased from the center in the width direction toward both ends in the width direction. Consequently, it is possible to disperse the wrinkles in the width direction.

Therefore, during the suction, the opening amount of the individual suction valves 436A to 436G is individually controlled such that the chamber placed closer to both end sides in the width direction has the lower suction force. In this example, the suction chamber 420 is divided into seven chambers 420A to 420G and the chamber 420D is placed in the center. Accordingly, the opening amount of the individual suction valves 436A to 436G is adjusted such that the suction force of the chamber 420D in the center is the highest and next, the suction force is decreased in the order of the chambers 420C and 420E→the chambers 420B and 420F→the chambers 420A and 420G.

Accordingly, similarly to the above-described first embodiment, the paper P can be stretched while the wrinkles are dispersed in the width direction. Without causing wrinkles or floats, the paper P can be wound around the image recording drum 41.

Furthermore, in the above-described embodiment, the opening amount of the individual suction valves 436A to 436G is individually controlled and thereby the suction force of the respective chambers 420A to 420G is configured to be controlled. However, the suction force of each of the individual suction pumps 432A to 432G may be individually controlled and thereby the suction force of the respective chambers 420A to 420G can be controlled.

Other Embodiment

Figure 19:
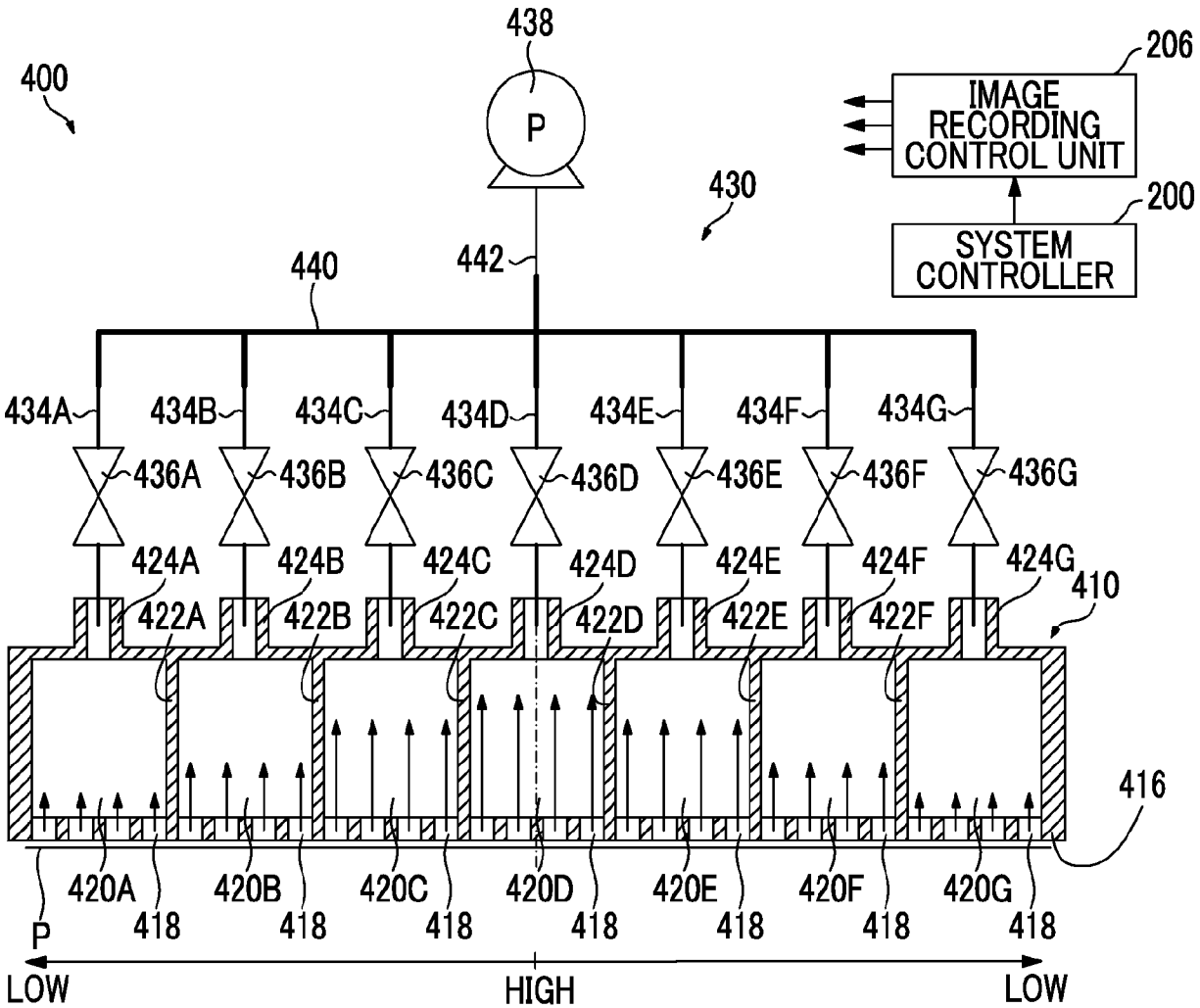
FIG. 19 illustrates another embodiment (modification example) of the back tension provider.

The above-described embodiment has the configuration where the individual suction pumps 432A to 432G are provided at each of the chambers 420A to 420G. However, as illustrated in FIG. 19, it may be the configuration where the respective chambers 420A to 420G are sucked by one pump.

In this case, as illustrated in the same drawing, the individual suction tubes 434A to 434G connected to the respective chambers 420A to 420G are combined by a diverging tube (manifold) 440 and then connected to a common suction tube 442, and the common suction tube 442 is connected to a common suction pump 438. The adjustment of the suction force of the respective chambers 420A to 420G is performed by individually controlling the opening amount of the individual suction valves 436A to 436G provided at the individual suction tubes 434A to 434G of the respective chambers 420A to 420G.

According this configuration, since it is unnecessary to dispose the suction pump for each chamber, it is possible to simplify a configuration for the apparatus.

Control of Suction Force Depending on Paper

As described above, in the back tension provider 400 of the present embodiment, it is possible to control the adsorption force acting on the paper P by adjusting the opening amount of the individual suction valves 436A to 436G provided corresponding to the respective chambers 420A to 420G. It is possible to more efficiently prevent the occurrence of wrinkles or the like by changing the adsorption force acting on the paper P depending on the type or the like of the paper.

Figure 20:
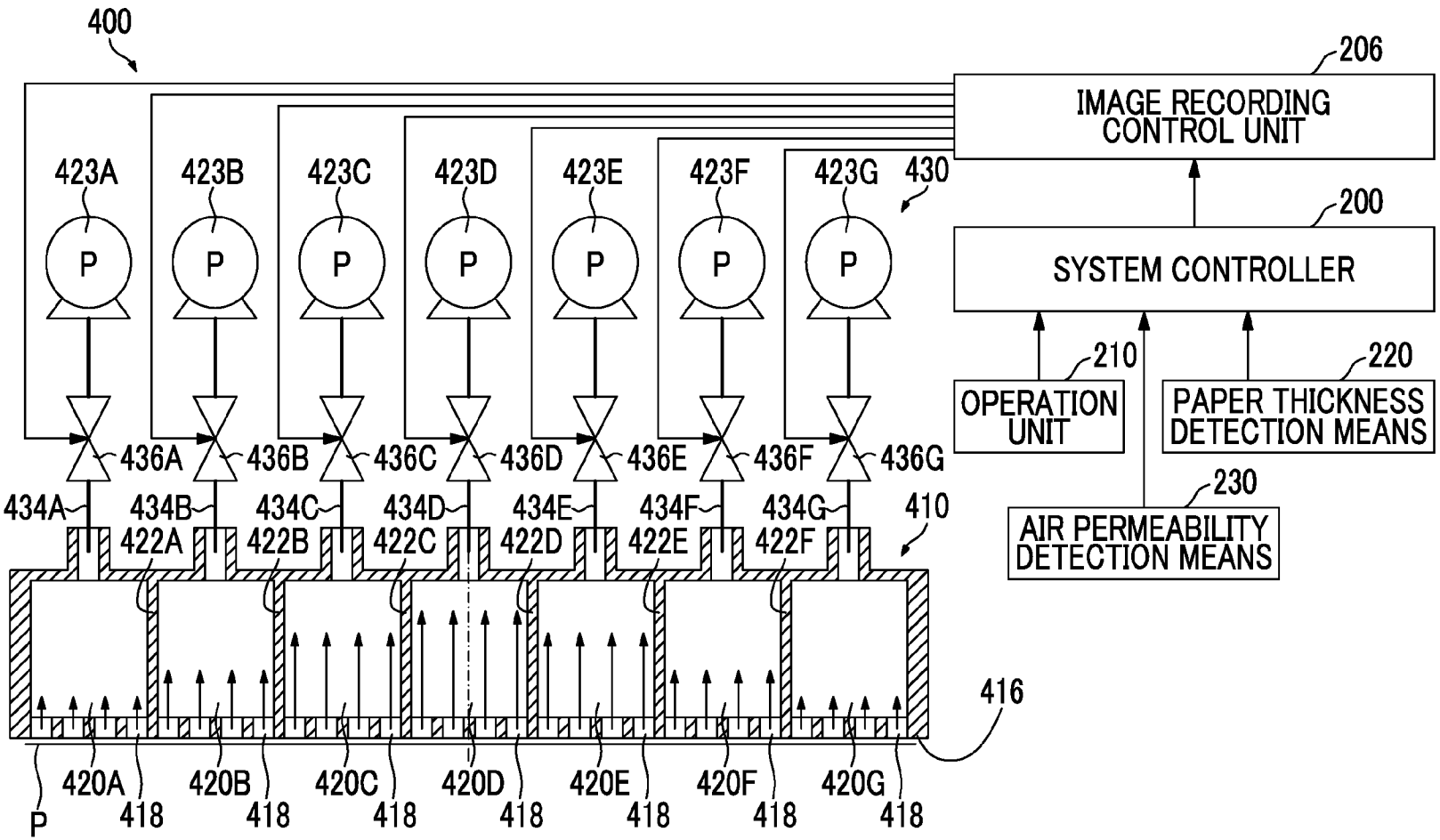

FIG. 20 is a configuration diagram of a system for controlling the adsorption force acting on the paper depending on the type or the like of the paper.

As described above, it is possible to more efficiently prevent the occurrence of wrinkles or the like by changing the adsorption force depending on the type or the like of the paper P.

For example, it is possible to set the strength, the distribution and the like of the acting adsorption force, depending on the type, thickness, air permeability of the paper P, whether or not the paper is printed (whether or not the reverse surface side is to be printed in a case of duplex printing) or the like. For example, these pieces of information are set, being previously input from the operation unit 210 by a user. That is, the user previously inputs the information related to the type, thickness, air permeability of the paper P, whether or not the paper is printed or the like, from the operation unit 210 as paper information acquisition unit, and based on the input information, the strength, the distribution and the like of the adsorption force are set. The strength or the distribution of the adsorption force to be set for each settable thickness of the paper is previously determined and then is stored in the memory. In a case where a plurality of pieces of information is combined to be set, the strength or the distribution of the adsorption force to be set is determined for each combination and then is stored in the memory. The system controller (control unit) 200 sets the adsorption force from the input information with reference to the information stored in the memory.

In addition, if means for automatically detecting the type, thickness, air permeability of the paper P, whether or not the paper is printed, or the like is provided at the ink jet recording apparatus, the adsorption force can be set based on the information acquired from the detection means as the paper information acquisition unit.

For example, in a case where paper thickness detection means (paper thickness detection unit) 220 for detecting the thickness of the paper P is provided as the paper information acquisition unit, it is possible to set the adsorption force based on the information (information related to the thickness of the paper P) obtained from the paper thickness detection means (paper thickness detection unit) 220. For the paper thickness detection means (paper thickness detection unit) 220, it is possible to use a well-known one, and for example, it is possible to dispose it at the paper feeding unit 20.

In addition, for example, in a case where air permeability detection means (air permeability detection unit) 230 for detecting the air permeability of the paper P is provided as the paper information acquisition unit, it is possible to set the adsorption force based on the information (information related to the air permeability of the paper P) obtained from the air permeability detection means (air permeability detection unit) 230. For example, it is possible to perform the detection of the air permeability in such a manner that the air is blown against the surface of the paper P and the transmitted amount to the reverse surface is detected.

In addition, for example, in a case where an imaging unit (for example, a camera, a scanner or the like) for imaging the reverse surface (opposite side surface to the printing surface) of the paper P is provided as the paper information acquisition unit, it is possible to detect whether or not the paper is printed, based on the information obtained from the imaging unit. Based on the information, it is possible to set the adsorption force.

In this manner, it is possible to automatically set the optimal adsorption force (strength, distribution or the like) using the information obtained from the detection means or units by providing various detection means or units that detect the information of the paper. Further, even in a case of automatic setting, the adsorption force is set to be decreased from the center toward both ends in the width direction of the paper P. Accordingly, the paper can be stretched while the wrinkles are dispersed in the width direction.

Furthermore, in the above-described embodiment, the suction chamber 420 is divided into seven chambers, but the number of dividing the suction chamber 420 is not limited thereto. The suction chamber 420 can be further divided into a lot of chambers, or can be divided into a less number of chambers. In this case, it is preferable to divide the suction chamber 420 into an odd number and to divide it to be symmetrical. Accordingly, it is possible to easily form the desired distribution of the adsorption force (distribution such that highest adsorption force is in the center and the adsorption force is decreased toward both ends).

In addition, in the above-described embodiment, the suction force of the respective chambers 420A to 420G is configured to be individually adjusted by adjusting the opening amount of the individual suction valves 436A to 436G provided for each of the chambers 420A to 420G. However, the suction force of the respective chambers 420A to 420G can be configured to be individually adjusted by controlling the drive of the individual suction pumps 432A to 432G provided for each of the chambers 420A to 420G.

In addition, in the present embodiment, the shape of the adsorption holes 418 is set to be circular, but the shape of the adsorption holes is not limited thereto. For example, it is possible to form the adsorption holes 418 to have an oval shape, a polygonal shape, a slit-shape and the like. In addition, even in this example, it is possible to form the respective adsorption holes 418 by gathering a plurality of the small diameter holes (refer to FIG. 12). Accordingly, it is possible to prevent the paper P from being deformed along the adsorption holes and the traces of the adsorption holes remaining.

Third Embodiment

In the above-described second embodiment, the suction chamber 420 is divided into a plurality of the chambers, and the suction force of the respective chambers 420A to 420G is configured to be individually adjusted by adjusting the opening amount of the individual suction valves 436A to 436G provided for each of the chambers 420A to 420G.

In the present embodiment, the suction chamber is divided into a plurality of the chambers by the division walls and the suction force of the respective chambers is adjusted such that the respective chambers adjacent to each other are communicated with each other using a communication port provided on the division wall and then the opening size of the communication port is changed.

Furthermore, the configuration other than back tension provider is the same as that of the paper conveyance mechanism of the above-described second embodiment. Therefore, herein, only the back tension provider will be described.

Figure 21:
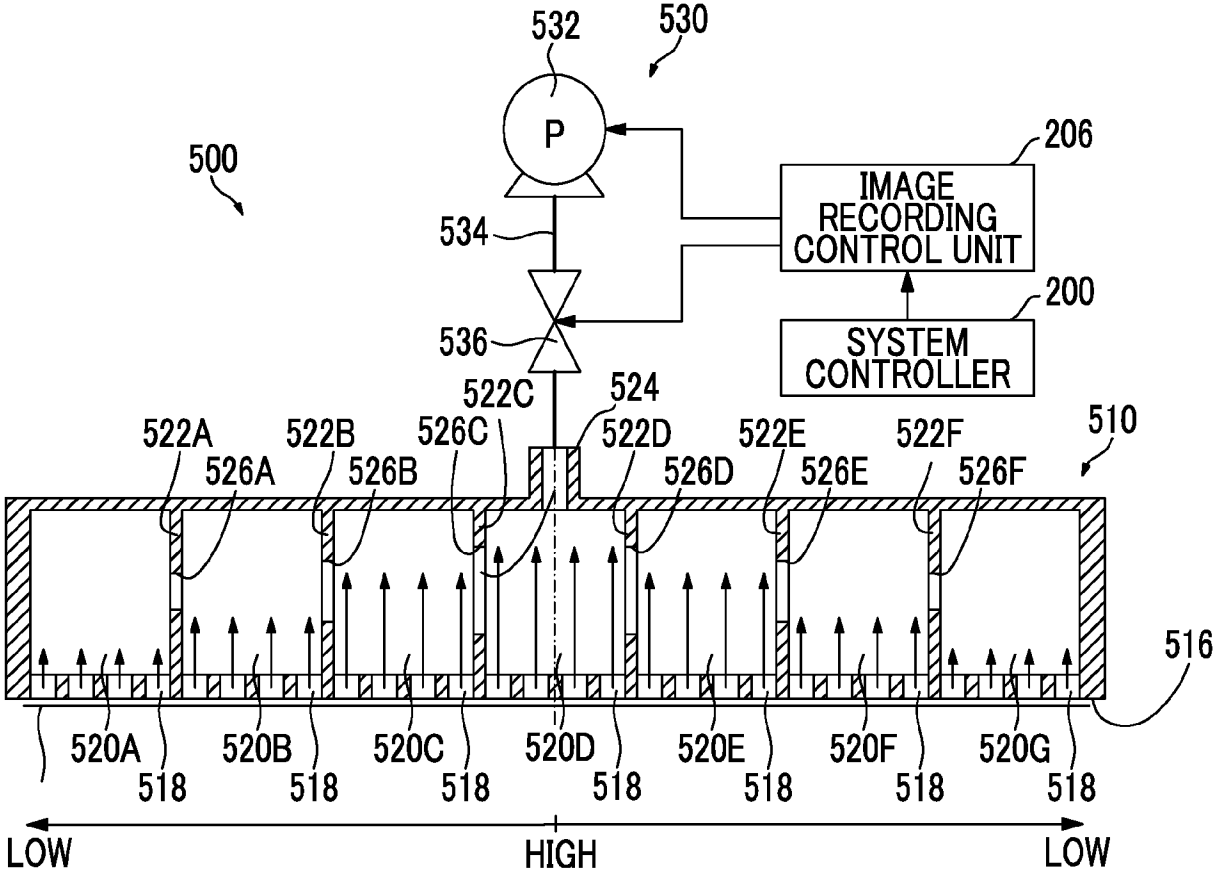
FIG. 21 is a schematic configuration diagram of the back tension provider to be incorporated in the paper conveyance mechanism of the second embodiment.

FIG. 21 is a schematic configuration diagram of the back tension provider to be incorporated in the paper conveyance mechanism of the third embodiment.

The back tension provider (back tension providing unit) 500 is also mainly configured by a paper guide 510 and a suction unit 530.

The paper guide 510 is formed such that the cross-section in the direction parallel to the conveyance direction of the paper P has a hollow box shaped in a trapezoidal shape (box shape widening toward the end). The paper guide 510 is formed corresponding to the width of the paper. Accordingly, the width thereof (width in the direction orthogonal to the conveyance direction of the paper P) is formed to be approximately the same as the width of the image recording drum 41.

In the paper guide 510, an adsorption surface 516 is formed on the surface opposing the image recording drum 41 in order to adsorb the paper P. The adsorption surface 516 is formed to be flat. The paper P slides on the adsorption surface while being sucked.

Similarly to the above-described second embodiment, the paper guide 510 is disposed close to the press roller 42. In addition, the adsorption surface 516 is placed so as to be along the tangent of the image recording drum 41 in the disposal point of the press roller 42 (refer to FIG. 4).

Similarly to the adsorption surface 416 of the paper guide 410 of the above-described second embodiment, multiple adsorption holes 518 are formed on the adsorption surface 516 (refer to FIG. 17). The respective adsorption holes 518 are formed in the same shape (formed with the same opening size). In addition, the respective adsorption holes 518 are placed at a constant pitch in the conveyance direction of the paper P and placed at a constant pitch in the direction orthogonal to the conveyance direction (width direction of the adsorption surface 516) of the paper P. That is, the adsorption holes 518 with the same size are equally placed on the entire surface of the adsorption surface 516.

The interior space of the paper guide 510 is a suction chamber 520, which is formed with the approximately the same width as the width of the adsorption surface 516. Each of the adsorption holes 518 is formed so as to communicate with the suction chamber 520.

The suction chamber 520 is divided into a plurality of chambers 520A to 520G by a plurality of division walls 522A to 522F. The division walls 522A to 522F are placed along the conveyance direction of the paper P (placed in the direction orthogonal to the width direction of the adsorption surface), and divide the suction chamber 520 into a plurality of the chambers 520A to 520G along the width direction. In this example, the suction chamber 520 is divided into seven chambers 520A to 520G by six division walls 522A to 522F, and the chambers 520A to 520G are symmetrically placed. Communication ports 526A to 526F are respectively formed on the division walls 522A to 522F and the communication ports 526A to 526F allow the adjacent chambers to communicate with each other. That is, for example, the chamber 520A and the chamber 520B communicate with each other using the communication port 526A formed on the division wall 522A, and the chamber 520B and the chamber 520C communicate with each other using the communication port 526B formed on the division wall 522B. In this manner, the adjacent chambers communicate with each other using the communication ports 526A to 526F formed on the division walls which partition the chamber and the chamber.

The respective chambers 520A to 520G are formed with the same size and are formed independently of each other. The adsorption holes 518 formed on the adsorption surface 516 communicate with any one of the chambers 520A to 520G. That is, the adsorption holes 518 placed on a formation region of the respective chambers 520A to 520G individually communicate with the respective chambers 520A to 520G. Accordingly, for example, the adsorption holes 518 placed on the formation region of the chamber 520A communicate only with the chamber 520A.

A suction port 524A is formed in the center in the width direction on the upper surface (opposite side surface to the adsorption surface 416) of the paper guide 510. The suction port 524A communicates with the chamber 520D in the center. Accordingly, if the air is sucked from the suction port 524, the chamber 520D in the center is sucked (to have a negative pressure).

As described above, the adjacent chambers communicate with each other using the communication ports 526A to 526F formed on the division walls 522A to 522F. Consequently, if the chamber 520D in the center is sucked, all the chambers are sucked via the communication ports 526A to 526F.

Here, the communication ports 526A to 526F formed on the respective division walls 522A to 522F are formed with a different size and formed such that the opening size is gradually decreased from the center toward both ends. That is, the opening size of the division walls 522C and 522D located closest to the center is formed to be large and the opening size of the division walls 522A and 522F located at both ends is formed to be small (if the opening sizes of the communication ports 526A to 526F formed on the respective division walls 522A to 522F are respectively referred to as Sa to Sf, Sc, Sd>Sb, Se>Sa, Sf).

In this manner, by forming the opening size of the communication ports 526A to 526F formed on the respective division walls 522A to 522F so as to be gradually decreased from the center toward both ends in the width direction, the suction force of the respective chambers 520A to 520G is gradually decreased from the center toward both ends in the width direction. Accordingly, the adsorption force of the paper is decreased from the center in the width direction toward both ends in the width direction.

The suction unit 530 sucks the insides of the suction chambers 520A to 520F of the paper guide 510. The suction unit 530 includes a suction pump 532, a suction tube 534 and a suction valve 536.

The suction pump 532 is configured by a vacuum pump. The drive of the suction pump 532 is controlled by the system controller 200 via the image recording control unit 206.

The suction tube 534 connects the suction pump 532 and the paper guide 510. In the suction tube 534, one end is connected to the inlet port of the suction pump 532 and the other end is connected to the suction port 524 of the paper guide 510.

The suction valve 536 is disposed in the middle of the conduit line of the suction tube 534. The suction valve 536 is formed such that the opening amount is adjustable. The opening amount of the suction valve 536 is controlled by the system controller 200 via the image recording control unit 206.

If the suction pump 532 is driven, the suction chamber 520D in the center is sucked to be evacuated via the suction tube 534. As described above, the adjacent chambers communicate with each other using the communication ports 526A to 526F formed on the division walls 522A to 522F. Accordingly, if the chamber 520D in the center is sucked, all the chambers are sucked via the communication ports 526A to 526F.

In addition, since the communication ports 526A to 526F formed on the respective division walls 522A to 522F are formed such that the opening size gradually becomes smaller from the center toward both ends, the suction force of the respective chambers 520A to 520G is gradually decreased from the center toward both ends in the width direction. Accordingly, the adsorption force acting on the paper P in the adsorption surface 516 is decreased from the center in the width direction toward both ends in the width direction.

In this manner, even in the back tension provider 500 of the present embodiment, desired distribution (distribution such that the adsorption force is gradually decreased from the center in the width direction toward both ends in the width direction) in the adsorption force acting on the paper P can be allowed. Accordingly, similarly to the first and second embodiments, the paper P can be stretched while the wrinkles are dispersed in the width direction. Thus, without causing wrinkles or floats, the paper P can be wound around the image recording drum 41.

Furthermore, in the above-described embodiment, the suction chamber 520 is divided into seven chambers, but the number of dividing the suction chamber 520 is not limited thereto. The suction chamber 520 can be further divided into a lot of chambers, or can be divided into a less number of chambers. In this case, it is preferable to divide the suction chamber 520 into an odd number and to divide it to be symmetrical. Accordingly, it is possible to easily form the desired distribution of the adsorption force (distribution such that highest adsorption force is in the center and the adsorption force is decreased toward both ends).

In the above-described embodiment, the respective communication ports 526A to 526F are formed by one hole each, but may be formed by a plurality of holes. In a case where the respective communication ports 526A to 526F are formed by a plurality of the holes, the sum of the opening sizes is formed to be gradually decreased from the center toward both ends.

In addition, in the present embodiment, the shape of the adsorption holes 518 is set to be circular, but the shape of the adsorption holes is not limited thereto. For example, it is possible to form the adsorption holes 518 to have an oval shape, a polygonal shape, a slit-shape and the like. In addition, even in this example, it is possible to form the respective adsorption holes 518 by gathering a plurality of the small diameter holes (refer to FIG. 12). Accordingly, it is possible to prevent the paper P from being deformed along the adsorption holes and the traces of the adsorption holes remaining.

In addition, in the above-described embodiment, an example where the division walls 522A to 522F are integrally formed with the paper guide 310 is described. However, the division walls may be replaceable (configured such that a part of the division wall is attachable, detachable and replaceable). Accordingly, the size of the communication port can be changed depending on the paper and the appropriate adsorption force can be provided for each paper.

For example, by preparing a plurality of the division walls whose opening sizes of the communication ports are different, the division wall to be used may be replaced depending on the type, thickness, air permeability, whether or not the paper is printed, and the like of the paper P.

In addition to this, the communication ports formed on the respective division walls 522A to 522F are formed to be expandable and contractible (for example, to provide an adjusting mechanism of the opening size, such as an iris mechanism) so as to adjust the opening size of the communication ports. Even in this case, the same effect can be obtained.

Another Embodiment

In the above-described embodiment, the configuration is made such that the surface of the paper P is adsorbed at the position immediately before the paper P is pressed by the press roller 42 and the paper P is provided with the back tension. However, it may be a configuration where the reverse surface of the paper P is adsorbed and the paper P is provided with the back tension. For example, it may be the configuration where a plurality of the adsorption holes is formed on a guide surface of the guide plate 82 arranged at the bottom of the delivery cylinder 80, the reverse surface of the paper P is adsorbed from the adsorption holes and the paper P is provided with back tension. Even in this case, the suction force is formed so as to be decreased from the center in the width direction toward both ends in the width direction of the paper P. Accordingly, the paper P can be stretched while the wrinkles are dispersed in the width direction. Without causing wrinkles or floats, the paper P can be wound around the image recording drum 41.

Furthermore, as in the present embodiment, even in a case of the paper being printed, it is possible to provide the back tension without damaging the printed image, by adsorbing the surface of the paper P. In addition, since the paper P can be held up to the position (position where the paper is nipped by the press roller 42) of immediately before the paper P is wound around the image recording drum 41, it is possible to more efficiently prevent the occurrence of wrinkles or floats.

In addition, in the above-described embodiment, the press roller 42 is formed in a so-called straight shape (outer diameter has a constant shape), but the press roller formed in a so-called crown shape (shape where the outer diameter becomes smaller from the center toward both ends) can be also used. It is possible to press the paper P while the paper P is stretched in the width direction, by pressing the surface of the paper P using the press roller 42 having such a shape.

In addition, in the above-described embodiment, the adsorption surfaces 316, 416 and 516 of the paper guides 310, 410 and 510 have a flat shape, but the shape of the adsorption surfaces 316, 416 and 516 is not limited to the flat shape. For example, the shape of the adsorption surfaces 316, 416 and 516 may be formed to have an arc shape. In this case, the shape of the cross-section in the longitudinal direction (direction parallel to the conveyance direction of the paper P) may be formed to have a circular arc shape which is convex toward the image recording drum, and the shape of the cross-section in the longitudinal direction may be formed to have the circular arc shape which is concave toward the opposite side to the image recording drum. In addition, the shape of the cross-section in the width direction (direction orthogonal to the conveyance direction of the paper P) may be formed to have the circular arc shape which is convex toward the image recording drum, and the shape of the cross-section in the width direction may be formed to have the circular arc shape which is concave toward the opposite side to the image recording drum. In addition, the adsorption surfaces 316, 416 and 516 may be formed such that the shape of the cross-section in the longitudinal direction and the shape of the cross-section in the width direction respectively have the circular arc shape.

In addition, in the above-described embodiment, an example where the present invention is adopted to the paper conveyance mechanism of the image recording drum 41, but the present invention can be adopted to the other paper conveyance mechanism. For example, the present invention can be also adopted to the paper conveyance mechanism of the process liquid applying unit 30. In this case, the back tension provider is disposed at the position of immediately before the applying device 32 (applying roller). Accordingly, it is possible to prevent the occurrence of the wrinkles on the paper P to be pressed by the applying roller.

What is claimed is:

1. A paper conveyance apparatus which conveys a sheet of paper, comprising:

a drum that conveys the paper by winding the paper around an outer peripheral surface thereof and being rotated;

a press roller that presses a surface of the paper at a predetermined position on the outer peripheral surface of the drum and brings a reverse surface of the paper into contact with the outer peripheral surface of the drum; and a back tension providing unit having an adsorption surface by which the surface or the reverse surface of the paper to be wound around the drum is absorbed, the back tension providing unit being configured so that provides the paper with a back tension by causing the adsorption surface to adsorb the surface or the reverse surface of the paper with an adsorption force which decreases from the center in a width direction of the paper toward both ends in the width direction of the paper.

2. The paper conveyance apparatus according to claim 1, wherein the back tension providing unit includes:

a suction chamber;

a plurality of adsorption holes that is formed on the adsorption surface and communicates with the suction chamber; and a suction unit that sucks the suction chamber, and wherein the adsorption force is decreased from the center in the width direction of the paper toward both ends in the width direction with the plurality of adsorption holes on the adsorption surface being formed in a manner so that an opening ratio of the adsorption surface resulting from the adsorption holes is decreased from the center in a width direction of the adsorption surface toward both ends in the width direction.

3. The paper conveyance apparatus according to claim 2, wherein an opening size of the adsorption holes is made smaller the closer the adsorption holes are placed to both ends in the width direction of the adsorption surface.

4. The paper conveyance apparatus according to claim 3, wherein the opening size of the adsorption holes is adjustable by configuring the adsorption holes to be expandable and contractible.

5. The paper conveyance apparatus according to claim 2, wherein placement density of the adsorption holes decreases the closer the adsorption holes are placed from the center in the width direction toward both ends in the width direction of the adsorption surface.

6. The paper conveyance apparatus according to claim 1, wherein the back tension providing unit includes:

a suction chamber having a width corresponding to a width of the adsorption surface;

a plurality of adsorption holes that is equally placed on the adsorption surface and communicates with the suction chamber;

a plurality of division walls which divides an interior of the suction chamber into a plurality of chambers along a width direction of the suction chamber; and a suction unit that individually sucks each of the chambers, and wherein the adsorption force is adjusted by individually adjusting a suction force with which the suction unit suck each of the chambers.

7. The paper conveyance apparatus according to claim 6, wherein the suction unit includes:

individual suction tubes which individually communicate with each of the chambers;

individual suction pumps which are individually connected to each of the individual suction tubes; and individual valves which are individually provided at each of the individual suction tubes, and whose opening amount is adjustable, and wherein the suction force is adjusted by individually adjusting the opening amount of each of the individual valves.

8. The paper conveyance apparatus according to claim 7, further comprising:

a paper information acquisition unit that acquires paper information; and a control unit that controls the suction unit based on the paper information acquired by the paper information acquisition unit.

9. The paper conveyance apparatus according to claim 8, wherein the paper information acquisition unit acquires at least a piece of information related to a type, thickness, air permeability of the paper and whether or not the paper is printed.

10. The paper conveyance apparatus according to claim 6, wherein the suction unit includes:

individual suction tubes which individually communicate with each of the chambers;

a common suction tube to which each of the individual suction tubes is connected;

a common suction pump which is connected to the common suction tube; and individual valves which are individually provided at each of the individual suction tubes, and whose opening amount is adjustable, and wherein the suction force is adjusted by individually adjusting the opening amount of each of the individual valves.

11. The paper conveyance apparatus according to claim 10, further comprising:

a paper information acquisition unit that acquires paper information; and a control unit that controls the suction unit based on the paper information acquired by the paper information acquisition unit.

12. The paper conveyance apparatus according to claim 11, wherein the paper information acquisition unit acquires at least a piece of information related to a type, thickness, air permeability of the paper and whether or not the paper is printed.

13. The paper conveyance apparatus according to claim 6, further comprising:

a paper information acquisition unit that acquires paper information; and a control unit that controls the suction unit based on the paper information acquired by the paper information acquisition unit.

14. The paper conveyance apparatus according to claim 13, wherein the paper information acquisition unit acquires at least a piece of information related to a type, thickness, air permeability of the paper and whether or not the paper is printed.

15. The paper conveyance apparatus according to claim 1, wherein the back tension providing unit includes:

a suction chamber having a width corresponding to a width of the adsorption surface;

a plurality of adsorption holes that is equally placed on the adsorption surface and communicates with the suction chamber;

a plurality of division walls which divides an interior of the suction chamber into a plurality of chambers along a width direction of the suction chamber;

communication ports which are formed on the respective division walls and communicate with the adjacent chambers; and a suction unit that individually sucks each of the chambers, and wherein an opening size of the communication port is made smaller the closer the division walls are placed to both ends in the width direction of the adsorption surface.

16. The paper conveyance apparatus according to claim 15, wherein the opening size of the communication ports is adjustable by configuring the communication ports to be expandable and contractible.

17. The paper conveyance apparatus according to claim 1, wherein the back tension providing unit provides the paper with the back tension by adsorbing the surface of the paper at a position immediately before where the paper enters between the drum and the press roller.

18. An ink jet recording apparatus, comprising:

the paper conveyance apparatus according to claim 1; and an ink jet head that ejects ink droplets onto the paper conveyed by the drum to record images on the surface of the paper.

* * * * *